US012630349B2

(12) United States Patent
Lambert et al.

(10) Patent No.: US 12,630,349 B2
(45) Date of Patent: May 19, 2026

(54) CUP SYSTEM FOR SIMULTANEOUS DELIVERY OF CONTENTS FROM SEPARATED CUPS TO A MOUTH OF A USER

(71) Applicant: CRUNCH TECH, INC., Austin, TX (US)

(72) Inventors: Robert A. Lambert, Santa Susana, CA (US); Kevin S. Meyer, Austin, TX (US)

(73) Assignee: Crunch Tech, LLC, Boca Raton, FL (US)

( * ) Notice: Subject to any disclaimer, the term of this patent is extended or adjusted under 35 U.S.C. 154(b) by 523 days.

(21) Appl. No.: 17/530,562

(22) Filed: Nov. 19, 2021

(65) Prior Publication Data

US 2023/0159257 A1 May 25, 2023

(51) Int. Cl.
*B65D 81/32* (2006.01)
*A47G 19/12* (2006.01)
(Continued)

(52) U.S. Cl.
CPC ..... *B65D 81/3216* (2013.01); *A47G 19/12* (2013.01); *A47G 19/2205* (2013.01);
(Continued)

(58) Field of Classification Search
None
See application file for complete search history.

(56) References Cited

U.S. PATENT DOCUMENTS 2,740,575 A 4/1956 Fontaine
3,288,344 A 11/1966 Woollen
(Continued)

FOREIGN PATENT DOCUMENTS

EP 2559633 2/2013
KR 200277880 6/2002

OTHER PUBLICATIONS

The CrunchCup, "How the CrunchCup Works", Youtube.com, Published Jan. 21, 2020 <https://www.youtube.com/watch?v=7nN6vW-KLB0> (Year: 2020).*
(Continued)

*Primary Examiner* — Erik Kashnikow
*Assistant Examiner* — Thanh H Nguyen
(74) *Attorney, Agent, or Firm* — Fitch, Even, Tabin & Flannery LLP

(57) ABSTRACT

The present disclosure describes a cup system for simultaneous delivery of contents from separated cups to a mouth of a user. The cup system includes an outer cup, an inner cup, a lid, and a cap. The outer cup includes an upper lip with a threaded surface configured to engage with a mating threaded surface of a lid. The inner cup includes an engaging lip configured to engage with a lower inner lip and configured to form a seal between the inner cup and the lid, as well as a flange located below the engaging lip that extends outward from a periphery of the inner cup. The lid includes an outer wall with a lower outer lip comprising the mating threaded surface, the mating threaded surface is configured to engage with a threaded surface. The cap includes a mating engagement feature configured to engage with an inner wall engagement feature.

14 Claims, 18 Drawing Sheets

(51) Int. Cl.
*A47G 19/22* (2006.01)
*B65D 43/02* (2006.01)
*B65D 51/16* (2006.01)

(52) U.S. Cl.
CPC ..... *B65D 43/0231* (2013.01); *B65D 51/1683* (2013.01); *A47G 2019/122* (2013.01); *B65D 2543/00046* (2013.01); *B65D 2543/00092* (2013.01); *B65D 2543/00537* (2013.01)

(56) References Cited

U.S. PATENT DOCUMENTS

| | | | | |
|---|---|---|---|---|
| 5,706,980 | A | 1/1998 | Dickerson | |
| D471,808 | S | 3/2003 | de Castro Couto | |
| 6,528,105 | B1 | 3/2003 | Gerhart | |
| 6,641,854 | B2 | 11/2003 | Gerhart | |
| D490,272 | S | 5/2004 | Rohe | |
| D502,744 | S | 3/2005 | Hussaini | |
| D512,875 | S | 12/2005 | Maldonado | |
| 7,063,229 | B2 | 6/2006 | Westerhof | |
| D547,605 | S | 7/2007 | Edelstein | |
| D547,610 | S | 7/2007 | Edelstein | |
| D558,532 | S | 1/2008 | Peterson | |
| D565,901 | S | 4/2008 | Edelstein | |
| D569,176 | S | 5/2008 | Bodum | |
| D569,182 | S | 5/2008 | Homma | |
| D618,964 | S | 7/2010 | Eisenhardt | |
| 7,820,214 | B2 | 10/2010 | Groenke | |
| 7,866,183 | B2 | 1/2011 | Roth | |
| 8,215,481 | B1 * | 7/2012 | Knickerbocker .... | B65D 51/285 215/DIG. 8 |
| D687,262 | S | 8/2013 | Bucceri | |
| D688,523 | S | 8/2013 | Lees | |
| D690,161 | S | 9/2013 | Garner | |
| 8,596,491 | B2 | 12/2013 | Buck | |
| 8,789,718 | B1 * | 7/2014 | Daniel ..... | B65D 51/185 220/254.1 |
| 8,815,318 | B2 | 8/2014 | Zoss | |
| 8,870,010 | B2 | 10/2014 | Buck | |
| D716,654 | S | 11/2014 | Dubitsky | |
| D716,656 | S | 11/2014 | Carregui | |
| 8,919,592 | B2 | 12/2014 | Buck | |
| D723,332 | S | 3/2015 | Steel | |
| 8,973,776 | B1 | 3/2015 | Buck | |
| D734,152 | S | 7/2015 | Hager | |
| 9,078,535 | B1 | 7/2015 | Buck | |
| 9,181,009 | B1 | 11/2015 | Buck | |
| 9,260,228 | B2 | 2/2016 | Buck | |
| D756,773 | S | 5/2016 | Brannock | |
| D758,792 | S | 6/2016 | Karussi | |
| D763,620 | S | 8/2016 | Szymanski | |
| D763,621 | S | 8/2016 | Szymanski | |
| D773,895 | S | 12/2016 | Dai | |
| D781,103 | S | 3/2017 | Karussi | |
| 9,622,605 | B2 | 4/2017 | Buck | |
| 9,687,095 | B2 | 6/2017 | Riggan | |
| D796,324 | S | 9/2017 | Buck | |
| D797,510 | S | 9/2017 | Ke | |
| D806,545 | S | 1/2018 | Circosta | |
| D808,218 | S | 1/2018 | Seiders | |
| D808,712 | S | 1/2018 | Steininger | |
| D814,240 | S | 4/2018 | Kabalin | |
| 10,005,589 | B2 | 6/2018 | Shakeri Clark | |
| D830,127 | S | 10/2018 | Rohe | |
| D831,482 | S | 10/2018 | Meyers | |
| D832,642 | S | 11/2018 | Buck | |
| D833,817 | S | 11/2018 | Sletten | |
| D839,058 | S | 1/2019 | Irish | |
| 10,172,486 | B2 | 1/2019 | Ferraro | |
| 10,226,142 | B2 | 3/2019 | Green | |
| 10,232,997 | B2 | 3/2019 | Engel | |
| D858,196 | S | 9/2019 | Graham | |
| D871,839 | S | 1/2020 | Sun | |
| D871,852 | S | 1/2020 | Haas | |
| D872,537 | S | 1/2020 | Guccione | |
| 10,625,921 | B2 | 4/2020 | Johnson | |
| 10,654,623 | B2 | 5/2020 | Circosta | |
| 10,676,253 | B2 | 6/2020 | Brannock | |
| D905,505 | S | 12/2020 | Lambert | |
| 2002/0039609 | A1 | 4/2002 | Bezek | |
| 2002/0114870 | A1 | 8/2002 | Rebhorn | |
| 2002/0155202 | A1 | 10/2002 | Rebhorn | |
| 2002/0192338 | A1 | 12/2002 | Ness | |
| 2004/0099544 | A1 | 5/2004 | Ness | |
| 2007/0045316 | A1 | 3/2007 | Arnljots | |
| 2007/0075079 | A1 | 4/2007 | Stokes | |
| 2007/0075081 | A1 | 4/2007 | Stokes | |
| 2007/0210093 | A1 * | 9/2007 | Pinelli ..... | B65D 43/20 220/715 |
| 2007/0227919 | A1 | 10/2007 | True | |
| 2008/0061069 | A1 | 3/2008 | Edelstein | |
| 2009/0266737 | A1 | 10/2009 | Cole | |
| 2010/0003379 | A1 | 1/2010 | Zoss | |
| 2011/0284564 | A1 | 11/2011 | Hsieh | |
| 2015/0201777 | A1 | 7/2015 | Kim | |
| 2015/0336723 | A1 | 11/2015 | Koennecke | |
| 2015/0344178 | A1 | 12/2015 | Szymanksi | |
| 2016/0088960 | A1 | 3/2016 | Liang | |
| 2016/0345780 | A1 | 12/2016 | Hatfield | |
| 2017/0113837 | A1 | 4/2017 | Szymanksi | |
| 2017/0225855 | A1 | 8/2017 | Lawson | |
| 2017/0273484 | A1 | 9/2017 | Spivey | |
| 2018/0009590 | A1 | 1/2018 | Wong | |
| 2018/0265255 | A1 | 9/2018 | Shakeri Clark | |
| 2018/0289186 | A1 | 10/2018 | Heiberger | |
| 2018/0312321 | A1 | 11/2018 | Wondka | |
| 2020/0039738 | A1 * | 2/2020 | Duman ..... | B65D 85/808 |

OTHER PUBLICATIONS

Logue, "Testing out the CrunchCup—Is it worth trying?", Youtube.com, Published Mar. 17, 2020 < https://www.youtube.com/watch?v=FZ0bMAITDzc0> (Year: 2020).*

Lambert et al; U.S. Appl. No. 29/709,646, filed Oct. 16, 2019.

The Crunch Cup; "The Crunch Cup—A Portable, No Spoon, No Bowl, Cereal Cup"; Aug. 9, 2020; downloaded Jan. 20, 2021 from https://thecrunchcup.com/products/crunch-cup?variant=31287550279780; 10 pages.

USPTO; Corrected Notice of Allowability for U.S. Appl. No. 29/709,646 mailed Nov. 19, 2020.

USPTO; Ex Parte Quayle Action for U.S. Appl. No. 29/709,646 mailed Jun. 18, 2020.

USPTO; Notice of Allowance for U.S. Appl. No. 29/709,646 mailed Aug. 12, 2020.

YouTube; "Best of Kickstarter—CrunchCup Cereal Cup"; Nov. 5, 2018; https://www.youtube.com/watch?v=xay3rJBkm68; downloaded Nov. 19, 2021; 3 pages.

* cited by examiner

CUP SYSTEM FOR SIMULTANEOUS DELIVERY OF CONTENTS FROM SEPARATED CUPS TO A MOUTH OF A USER

BACKGROUND OF THE INVENTION

1. Field of the Invention

The present invention relates generally to a drinking cup system, and more specifically to a drinking cup with multiple reservoirs.

2. Discussion of the Related Art

Various systems and processes are known in the art for drinking cup with multiple reservoirs.

A cup is a type of container used to hold liquids for pouring or drinking, storing solids for pouring (e.g., sugar, flour, grains), etc. Cups may be made of materials such as glass, metal, plastic, or other suitable materials. In some cases, cups may be fixed with a stem or a handle to assist the user in using the cup. Different cups can be used for different types of contents as well as for different types of applications (e.g., such as a coffee mug for coffee, pint glasses for cocktails, water bottles for water or sports drinks, etc.).

Traditionally, a cup includes a reservoir for holding such contents (e.g., whether the contents be solid or liquid). In some cases, a user may desire to keep certain contents separate, which may require multiple cups. There is a need in the art for a cup that can efficiently hold different contents of different types (e.g., such as solid contents and liquid contents), without requiring the contents be mixed within a single reservoir of the cup.

SUMMARY

An apparatus, system, and method for a drinking cup with multiple reservoirs are described. Specifically, an apparatus, system, and method for simultaneous delivery of contents from separated areas of a cup system to a mouth of a user are described.

In some embodiments, a cup system for simultaneous delivery of contents from separated cups to a mouth of a user is described. One or more aspects of the cup system include an outer cup, a lid, a cap, and an inner cup. In some aspects, the outer cup is configured to hold a liquid edible product and the inner cup is configured to hold a dry edible product.

The outer cup includes an upper lip comprising a threaded surface configured to engage with a mating threaded surface.

The lid comprises an outer wall, an inner wall, a fluid passage, and a vent hole. The outer wall has a lower outer lip comprising the mating threaded surface, wherein the mating threaded surface is configured to engage with the threaded surface. The inner wall defines a central opening, wherein a top edge of the inner wall is connected to a top edge of the outer wall, the inner wall comprising at least one engagement feature configured to engage with a mating engagement feature in a cap and having a lower inner lip configured to engage with an inner cup. The fluid passage in the lid is interposed between the lower outer lip and an inner edge of the lid, wherein the inner edge is at a periphery of the central opening.

The cap comprises the mating engagement feature and an opening. The mating engagement feature is configured to engage with the inner wall engagement feature, whereby upon engagement of the engagement features the cap is removably coupled to the lid and the central opening is spanned by the cap.

The inner cup comprises an engaging lip and a flange. The engaging lip is configured to engage with the lower inner lip and configured to form a seal between the inner cup and the lid. The flange is located below the engaging lip and extending outward from a periphery of the inner cup, wherein when the cup system is assembled by placing a first contents in the inner cup and engaging the lid with the inner cup, the outer cup, and the cap, wherein the cap opening is configured to pass the first contents out of the inner cup in response to at least partial inversion of the cup.

A method and system for providing a cup system for simultaneous delivery of contents from separated areas to a mouth of a user are described. One or more aspects of the method and system include providing an inner cup configured to hold a contents, wherein the inner cup includes an engaging lip and a flange located below the engaging lip and extending outward from a periphery of the inner cup. The method and system include coupling a lid to the inner cup, the lid having an inner wall with an inner lip configured to engage with the inner cup. The coupling further includes engaging the engaging lip of the inner cup with the inner lip of the lid, and the inner wall further includes at least one engagement feature configured to engage with a mating engagement feature in a cap. The lid further comprises an outer wall having an outer lip comprising a threaded surface, where a top edge of the inner wall is connected to a top edge of the outer wall. The inner wall further defines a central opening, and the lid further includes a vent hole and a fluid passage interposed between the lower outer lip and an inner edge of the lid, where the inner edge is at a periphery of the central opening.

The method and system further include coupling an outer cup to the lid by engaging a threaded surface of an upper lip of the cup to the threaded surface of the outer lip of the lid, where the inner cup is nested within the outer cup with a space between the outer cup and the inner cup. The method and system include coupling a cap to the lid by engaging an engagement feature of the cap with the inner wall engagement feature, where the cap is removably coupled to the lid and an opening in the cap provides a passage to an interior of the inner cup, and where the cap opening is configured to pass the contents out of the inner cup in response to at least partial inversion of the cup.

A method and system for using a drinking cup with multiple reservoirs are also described. One or more aspects of the method and system include retaining an inner cup holding a first contents, wherein the inner cup includes an engaging lip, and a flange located below the engaging lip and extending outward from a periphery of the inner cup. The method and system include coupling a lid to the inner cup, the lid having an inner wall with an inner lip configured to engage with the inner cup. The coupling further includes engaging the engaging lip of the inner cup with the inner lip of the lid, the inner wall further including at least one engagement feature configured to engage with a mating engagement feature in a cap. The lid includes an outer wall having an outer lip comprising a threaded surface, wherein a top edge of the inner wall is connected to a top edge of the outer wall. The inner wall further defining a central opening, the lid further including a vent hole and a fluid passage interposed between the lower outer lip and an inner edge of the lid, wherein the inner edge is at a periphery of the central opening.

The method and system further include retaining a second contents in an outer cup and coupling the outer cup to the lid by engaging a threaded surface of an upper lip of the outer cup to the threaded surface of the outer lip of the lid, whereby the inner cup is nested within the outer cup with a space between the outer cup and the inner cup and the second contents in the space. The method and system further include coupling a cap to the lid by engaging an engagement feature of the cap with the inner wall engagement feature, whereby the cap is removably coupled to the lid and an opening in the cap provides a passage to an interior of the inner cup, whereby the cup system is formed.

The method and system include inverting, at least partially, the cup system such that the cap opening is located above the fluid passage, whereby the second contents is discharged through the fluid passage and the first contents is simultaneously discharged through the cap opening.

A cup system for simultaneous delivery of contents from separated areas to a mouth of a user is described. One or more aspects of the apparatus and system include an outer cup comprising an upper lip comprising a threaded surface configured to engage with a mating threaded surface. One or more aspects of the apparatus and system include a lid comprising an outer wall having a lower outer lip comprising the mating threaded surface, the mating threaded surface configured to engage with the threaded surface. The lid includes an inner wall defining a central opening, wherein a top edge of the inner wall is connected to a top edge of the outer wall, the inner wall comprising at least one engagement feature configured to engage with a mating engagement feature in a cap, the inner wall further comprising an inner ledge configured to support an outer flange of a pod cup. The lid further includes a fluid passage and a vent. The fluid passage in the lid is interposed between the lower outer lip and an inner edge of the lid, wherein the inner edge is at a periphery of the central opening.

One or more aspects of the apparatus and system include a pod cup comprising an engaging lip including the outer flange configured to seat on and be supported by the inner lip of the lid such that a body of the pod cup extends downwards from the lid and an interior volume of the pod cup is in communication with the central opening. One or more aspects of the apparatus and system include a cap comprising the mating engagement feature configured to engage with the inner wall engagement feature, whereby upon engagement of the engagement features the cap is removably coupled to the lid and the central opening is spanned by the cap. The cap includes a lower rim configured such that when the engagement features are engaged, the outer flange is compressibly interposed between the inner lip of the lid and the lower rim of the cap, whereby a fluid seal is formed between the pod cup, the cap, and the lid. The cap further includes an opening, such that when the cup system is assembled by placing a contents in the inner cup and engaging the lid with the pod cup, the outer cup and the cap, the cap opening is configured to pass the contents out of the inner cup in response to at least partial inversion of the cup.

A method for simultaneous delivery of contents from separated areas to a mouth of a user is described. One or more aspects of the method include removing a pod lid from a pod cup and exposing a first contents held within the pod cup, the pod cup comprising an engaging lip including an outer flange configured to seat on and be supported by a lid of the cup system such that a body of the pod cup extends downwards from the lid and an interior volume of the pod cup is in communication with a central opening of the lid. One or more aspects of the method include inserting the pod into the central opening of the lid, the lid having an inner wall with an inner lip configured to engage with the inner cup. The coupling further includes engaging the engaging lip of the inner cup with the inner lip of the lid, the inner wall further comprising at least one engagement feature configured to engage with a mating engagement feature in a cap, and the lid further comprising an outer wall having an outer lip comprising a threaded surface. A top edge of the inner wall is connected to a top edge of the outer wall, the inner wall further defining the central opening, and the lid further comprising a vent hole and a fluid passage interposed between the lower outer lip and an inner edge of the lid. The inner edge is at a periphery of the central opening; retaining a second contents in an outer cup.

One or more aspects of the method further include coupling the outer cup to the lid by engaging a threaded surface of an upper lip of the outer cup to the threaded surface of the outer lip of the lid, whereby the inner cup is nested within the outer cup with a space between the outer cup and the inner cup and the second contents in the space. One or more aspects of the method include coupling, removably, the cap to the lid by engaging the mating engagement feature with the inner wall engagement feature, whereby the outer flange is compressibly interposed between the inner lip of the lid and the lower rim of the cap. Further, a fluid seal is formed between the pod cup, the cap, and the lid. The cap opening is configured to pass the contents out of the inner cup in response to at least partial inversion of the cup.

DETAILED DESCRIPTION

Figure 1:
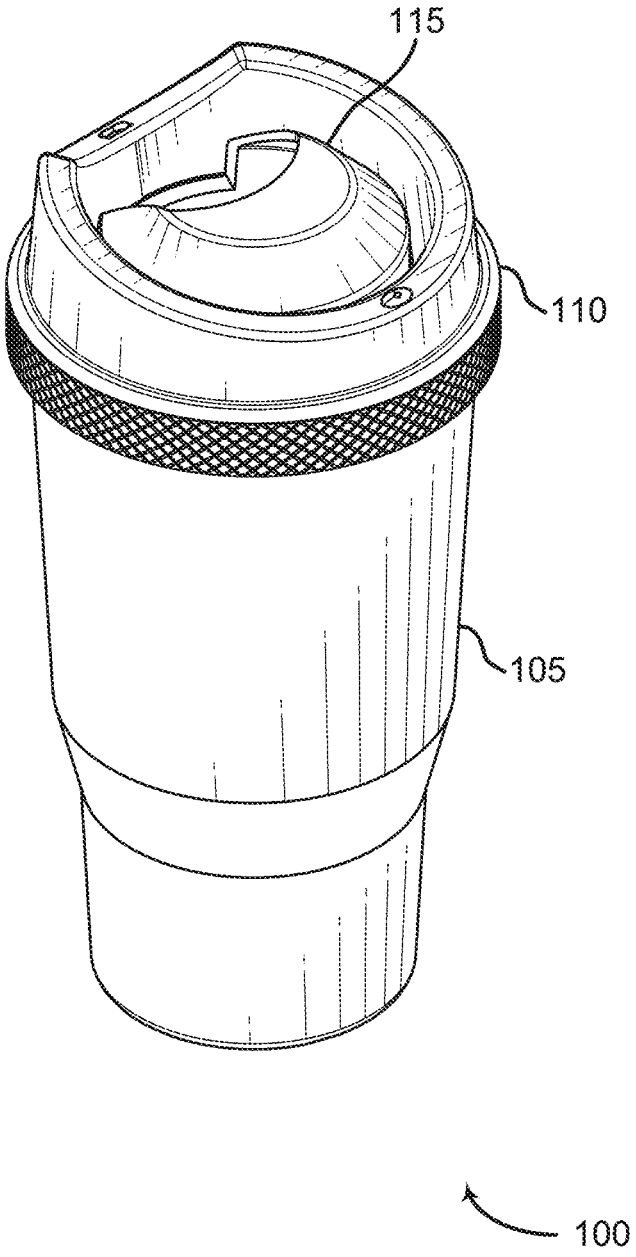
FIG. 1 shows an example of a perspective view of the cup system according to aspects of the present disclosure.

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

The present disclosure relates generally to a drinking cup system, and more specifically to a drinking cup with multiple reservoirs for simultaneous delivery of contents from separated reservoirs to a mouth of a user. In some embodiments, the present disclosure provides a cup system with a containment volume for a liquid content and another containment volume for a solid content. In another embodiment, the present disclosure provides a pod (e.g., a prefilled pod, a disposable pod, a reusable pod, etc.) that contains a solid content for consumption for use in conjunction within the cup system.

Traditional cups or cup systems provide a single reservoir (e.g., a single volume) for storing content. If a user wants to combine both a solid content and a liquid content, the user would be required to mix the two in a single vessel. In some cases, a user may wish to maintain certain contents separately. For instance, in the case of milk and cereal, mixing such contents may cause the cereal to become soggy over time. There is a need in the art for improved cup systems such that users may separately store contents without requiring multiple cup systems, which may otherwise be more cumbersome for the user to manage.

The present disclosure describes a portable cup system where contents (e.g., solid content and liquid content) can be separated until the user desires mixing of the contents (e.g., or separate access to each of the contents). For example, a user can access a solid content from one of the containment volumes, then the user can access liquid content separately. As such, the cup system may separately store, and provide simultaneous access to, multiple contents that do not mix until the user chooses to do so.

FIG. 1 shows an example of a perspective view of the cup system 100 according to aspects of the present disclosure. In one aspect, cup system 100 includes outer cup 105, lid 110, and cap 115. Cup system 100 is an example of, or includes aspects of, the corresponding element described with reference to FIGS. 2, 3, and 10-12.

Figure 2:
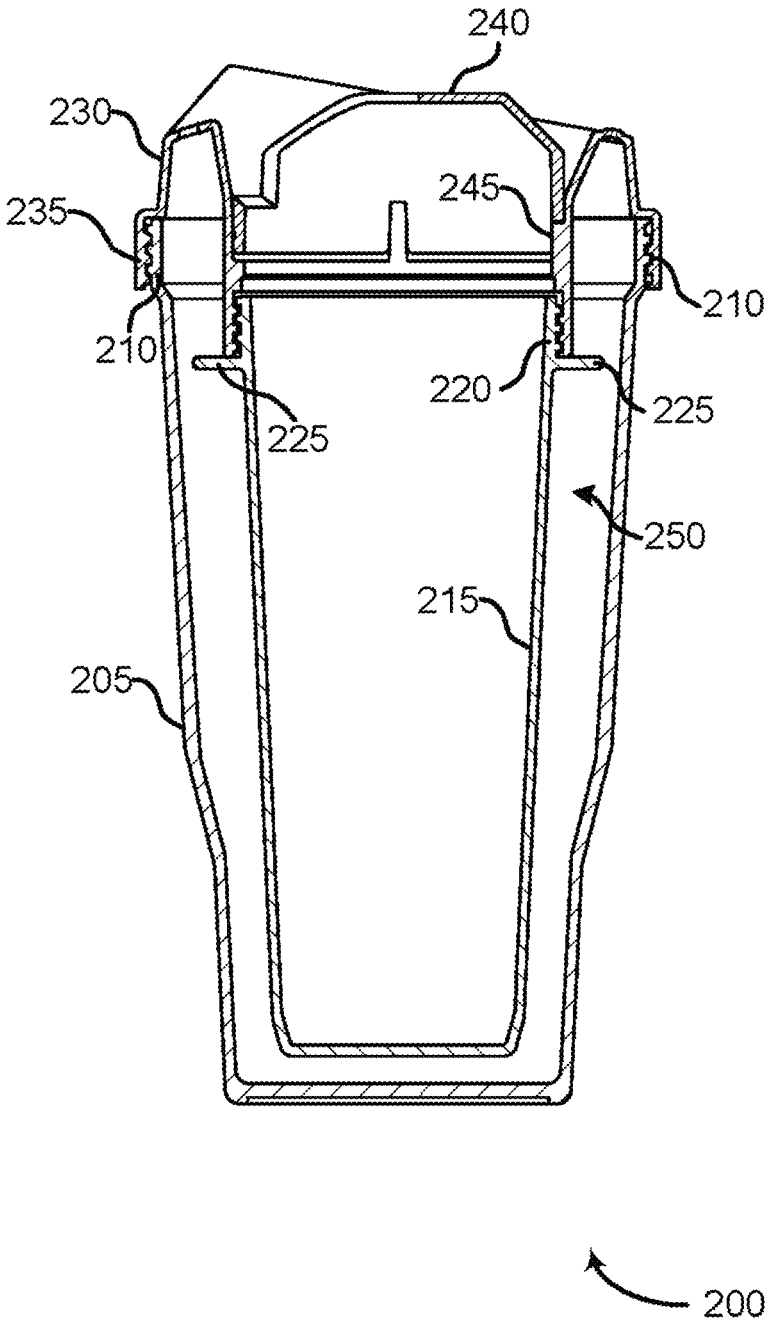
FIG. 2 shows an example of a cross section of the cup system according to aspects of the present disclosure.

FIG. 2 shows an example of a cross section of the cup system 200 according to aspects of the present disclosure. In one aspect, cup system 200 includes outer cup 205, inner cup 215, lid 230, cap 240, and engagement feature 245. Cup system 200 is an example of, or includes aspects of, the corresponding element described with reference to FIGS. 1, 3, and 10-12.

A cup system 200 for simultaneous delivery of contents from separated cups to a mouth of a user is described. One or more aspects of the cup system 200 include an outer cup 205, a lid 230, a cap 240, and an inner cup 215. In some aspects, the outer cup 205 is configured to hold a liquid edible product and the inner cup 215 is configured to hold a dry edible product.

Outer cup 205 includes an upper lip comprising a threaded surface 210 configured to engage with a mating threaded surface 235. Outer cup 205 further comprises outer cup inner surface 255.

Lid 230 includes an outer wall having a lower outer lip comprising the mating threaded surface 235, the mating threaded surface 235 configured to engage with the threaded surface 210. Lid 230 further includes an inner wall defining a central opening, wherein a top edge of the inner wall is connected to a top edge of the outer wall, the inner wall comprising at least one engagement feature 245 configured to engage with a mating engagement feature in a cap 240 and having a lower inner lip configured to engage with an inner cup 215. The inner wall of the lid 230 includes engagement feature 245 for aligning the cap 240 to the lid 230. The lid may include one or more engagement features 245 and the cap may include one or more mating engagement features. The engagement feature 245 is an example of, or includes aspects of, the corresponding element described with reference to FIGS. 4, 10 and 11. Lid 203 further comprises lid inner surface 265.

Further, a fluid passage in the lid 230 is interposed between the lower outer lip and an inner edge of the lid 230, where the inner edge is at a periphery of the central opening. The lid 230 includes a vent hole. In some aspects, the fluid passage may provide the content of the outer cup 205 to the user.

Cap 240 includes the mating engagement feature configured to engage with the inner wall engagement feature 245 of the lid 230. Upon engagement of the engagement features the cap 240 is removably coupled to the lid 230 and the central opening is spanned by the cap 240. The cap 240 further includes an opening (e.g., as described in more detail herein, for example, with reference to FIG. 5).

Inner cup 215 includes an engaging lip 220 configured to engage with the lower inner lip of the lid 230 and configured to form a seal between the inner cup 215 and the lid 230. Inner cup 215 further includes an inner cup outer surface 260 and a flange 225 located below the engaging lip 220 that extends outward from a periphery of the inner cup outer surface 260. The cup system 200 is assembled by placing a first contents in the inner cup 215 and engaging the lid 230 with the inner cup 215, the outer cup 205, and the cap 240, whereby space 250 is formed between the inner cup outer surface 260, the outer cup inner surface 255, and lid inner surface 265. As shown in FIG. 2, the flange 225 extends past the inner wall of the lid and into the space 250. The cap 240 opening is configured to pass the first contents out of the inner cup 215 (e.g., in response to at least partial inversion of the cup).

In some aspects, the cap 240 and the inner wall of the lid 230 further include matching key structures such that coupling of the cap 240 to the inner wall requires matching of the key structures.

Some examples of the apparatus, system, and method further include an outer surface of the outer wall comprising a textured surface for gripping.

Some examples of the apparatus, system, and method further include a threaded plug including a flange 225 made of insulating materials, wherein the threaded plug is configured to couple to the lid 230 in place of the inner cup 215.

Some examples of the apparatus, system, and method further include an interference fit plug including a flange 225 made of insulating materials, wherein the threaded plug is configured to couple to the lid 230 in place of the inner cup 215.

In some aspects, the at least one engagement feature 245 of the inner wall includes at least one horizontal indentation. In some aspects, the mating engagement feature of the cap 240 includes at least one horizontal boss, wherein the at least one horizontal boss and the at least one horizontal indentation form a snap-lock coupling.

The outer cup 205 may include male or female threads or use a push-on connection into the lid 230 with seals. The outer cup 205 may be plastic, stainless steel, or any other composites to aid in cosmetic and insulation properties.

Generally, embodiments of the present disclosure may include a male thread or a female thread for the inner cup 215 and outer cup 205 connection.

In some examples, the inner cup 215 may include a baffle and male or female threads. The baffle may also be a push-onto lid 230. The baffle can be molded into lid 230 as one unit or can be a separate ring. In some examples, a baffle ring may be used for flow control. The inner cup 215 may accept the pods.

In one aspect, outer cup 205 includes threaded surface 210. Outer cup 205 is an example of, or includes aspects of, the corresponding element described with reference to FIGS. 1, 9, and 12. Inner cup 215 is an example of, or includes aspects of, the corresponding element described with reference to FIGS. 6, 9, and 12. In one aspect, inner cup 215 includes engaging lip 220 and flange 225. Engaging lip 220 is an example of, or includes aspects of, the corresponding element described with reference to FIGS. 6, 7, and 9. Flange 225 is an example of, or includes aspects of, the corresponding element described with reference to FIGS. 6 and 9. In one aspect, lid 230 includes mating threaded surface 235. Lid 230 is an example of, or includes aspects of, the corresponding element described with reference to FIGS. 1, 3, 4, 8, 9, and 12. Cap 240 is an example of, or includes aspects of, the corresponding element described with reference to FIGS. 1, 3, 5, 8, and 12.

Figure 3:
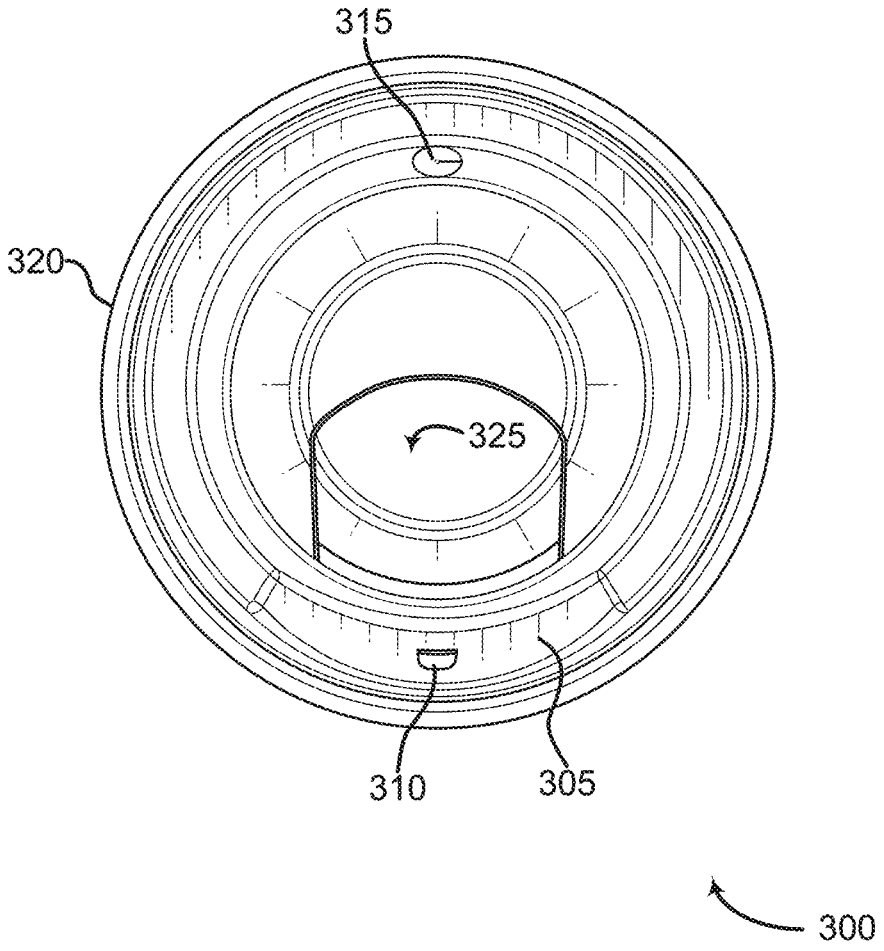
FIG. 3 shows an example of a top view of the cup system according to aspects of the present disclosure.

FIG. 3 shows an example of a top view of the cup system 300 according to aspects of the present disclosure. In one aspect, cup system 300 includes lid 305 and cap 320. In one aspect, lid 305 includes fluid passage 310 and vent hole 315. In one aspect, cap 320 includes opening 325. Cup system 300 is an example of, or includes aspects of, the corresponding element described with reference to FIGS. 1, 2, and 10-12.

As described herein, the opening 325 of the cap 320 is configured to pass the first contents (e.g., solid contents, dry contents, edible contents, etc.) out of the inner cup in response to at least partial inversion of the cup system 300. Further, the vent hole 315 may be configured to pass other contents (e.g., liquid contents, wet contents, drinkable contents, etc.) out of the outer cup in response to at least partial inversion of the cup system 300.

Lid 305 is an example of, or includes aspects of, the corresponding element described with reference to FIGS. 1, 2, 4, 8, 9, and 12. Fluid passage 310 is an example of, or includes aspects of, the corresponding element described with reference to FIG. 4. Vent hole 315 is an example of, or includes aspects of, the corresponding element described with reference to FIG. 4. Cap 320 is an example of, or includes aspects of, the corresponding element described with reference to FIGS. 1, 2, 5, 8, and 12. Opening 325 is an example of, or includes aspects of, the corresponding element described with reference to FIG. 5.

Figure 4:
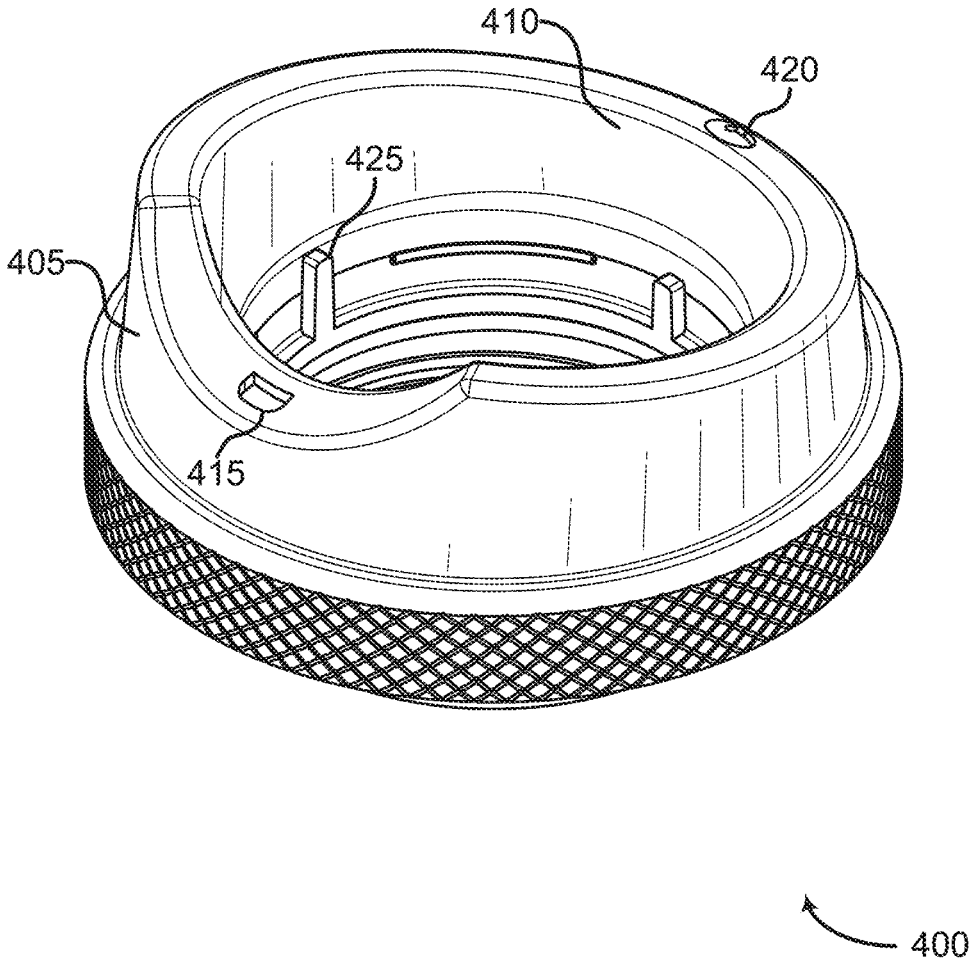
FIG. 4 shows an example of a lid of the cup system according to aspects of the present disclosure.

FIG. 4 shows an example of a lid 400 of the cup system according to aspects of the present disclosure. In one aspect, lid 400 includes outer wall 405, inner wall 410, fluid passage 415, vent hole 420, and engagement feature 425. Lid 400 is an example of, or includes aspects of, the corresponding element described with reference to FIGS. 1-3, 8, 9, and 12.

Lid 400 may include a top rim interposed between the top edge of the outer wall 405 and the top edge of the inner wall 410. In some aspects, the fluid passage 415 is located in the top rim.

In some aspects, the top rim is angled upward from the fluid passage 415 such that the fluid passage 415 is positioned at a trough of the top rim. In some aspects, the rim arcs slightly and continuously upward from the fluid passage 415.

In some aspects, vent hole 420 is located in the top rim. In some aspects, the fluid passage 415 is an open slot. In some aspects, the vent hole 420 is located generally opposite to the fluid passage 415. In some examples, the vent hole 420 is located next to the fluid passage 415. Alternatively, the vent and fluid passage 415 may be located at any position on the lid 400.

In some aspects, an outer surface of a portion of the lid 400 surrounding the vent hole 420 is a raised convex oval shape. In some examples, the corresponding lower surface of the portion is a concave oval shape.

In some aspects, the at least one engagement feature of the lid 400 inner wall 410 includes a horizontal rib. In some aspects, the cap has a raised, convex shape. Additionally, the inner wall 410 includes engagement feature 425, configured to align the cap or a pod with the lid. The engagement feature 425 is an example of, or includes aspects of, the corresponding element described with reference to FIGS. 2, 10 and 11.

In some aspects, the lid 400 has a funnel design. In some aspects, the lid 400 has a reverse funnel design. Funnel and reverse funnel designs may be used with inner and outer snap rings to hold an outer cup and pod. In some aspects, the lid 400 may include an outer snap ring with a molded inner cup or pod as one unit.

The lid 400 may be used to cover or contain contents in a cup system. In some embodiments, the lid 400 is used to maintain the temperature of the contents of the cup system. A textured collar may be used on the lid 400.

Some embodiments of the present disclosure may use a reusable lid 400. Some embodiments of the present disclosure may use a disposable lid 400.

In some examples, the vent hole 420 may be raised. In some aspects, the vent hole 420 may be used to control the airflow into the liquid chamber of the cup, therefore controlling liquid flow from the fluid passage 415 (e.g., when the cup is inverted). As a result, the airway (vent hole 420)

may be sealed off with little finger pressure and can be used when visually impaired due, for example, while driving.

Outer wall 405 is an example of, or includes aspects of, the corresponding element described with reference to FIG. 10. Inner wall 410 is an example of, or includes aspects of, the corresponding element described with reference to FIG. 10. Fluid passage 415 is an example of, or includes aspects of, the corresponding element described with reference to FIG. 3. Vent hole 420 is an example of, or includes aspects of, the corresponding element described with reference to FIG. 3.

Figure 5:
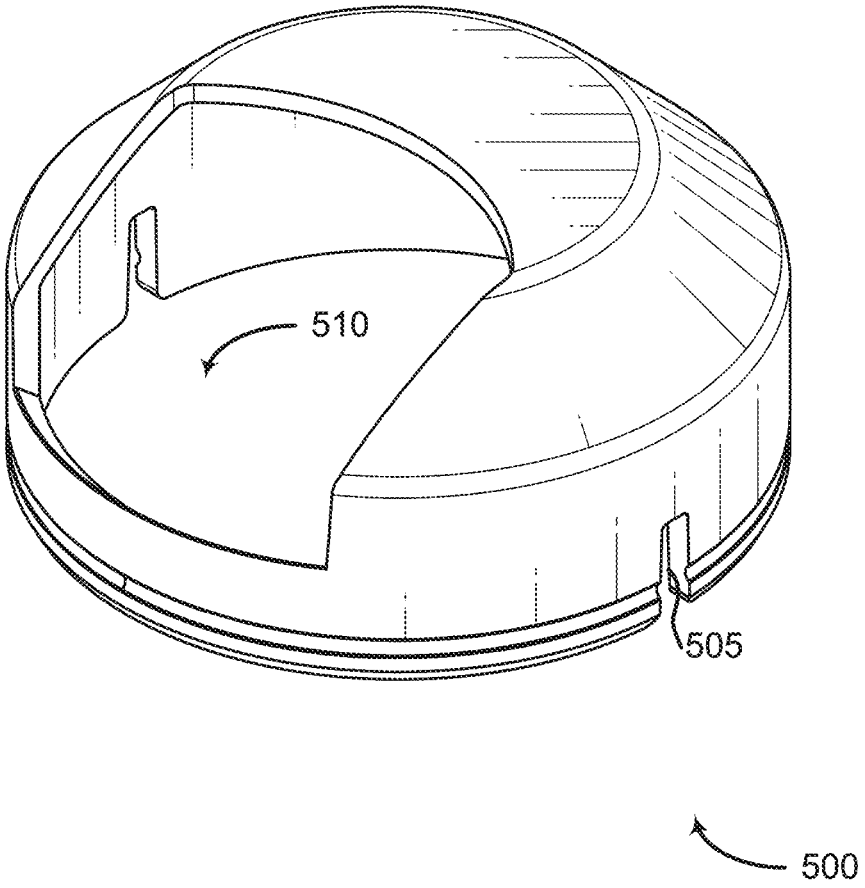
FIG. 5 shows an example of a cap of the cup system according to aspects of the present disclosure.

FIG. 5 shows an example of a cap 500 of the cup system according to aspects of the present disclosure. In one aspect, cap 500 includes mating engagement feature 505 and opening 510. Cap 500 is an example of, or includes aspects of, the corresponding element described with reference to FIGS. 1-3, 8, and 12.

Some examples of the apparatus, system, and method further include a cap 500 lid configured to cover the opening 510. Some examples of the apparatus, system, and method further include a cap 500 lid that attaches to the cap 500 and flips into a position to cover the opening 510. Some examples of the apparatus, system, and method further include a cap 500 lid that is configured to snap to the cap 500 to cover the opening 510.

Embodiments of the present disclosure may use a reusable cap 500. For example, a standard snap-in cap 500 with alignment keys, flip-lid, or a rotating cap 500 for spill-proof application of the dry material may be used. Therefore, the pod may be held in position.

Opening 510 provides the user with the contents of the inner cup. The opening 510 may be large enough for solid material such as cereal to pass through without clogging, but the present disclosure is not limited thereto and the opening 510 may be relatively small. Opening 510 is an example of, or includes aspects of, the corresponding element described with reference to FIG. 3.

In some examples, mating engagement feature 505 in a cap 500 has a lower inner lip (e.g., male or female threading) configured to engage with the inner wall engagement feature of the lid. The mating engagement feature 505 may be a notch providing a place for the engagement feature of the lid to insert. As such, the cap may be substantially aligned to the lid.

Figure 6:
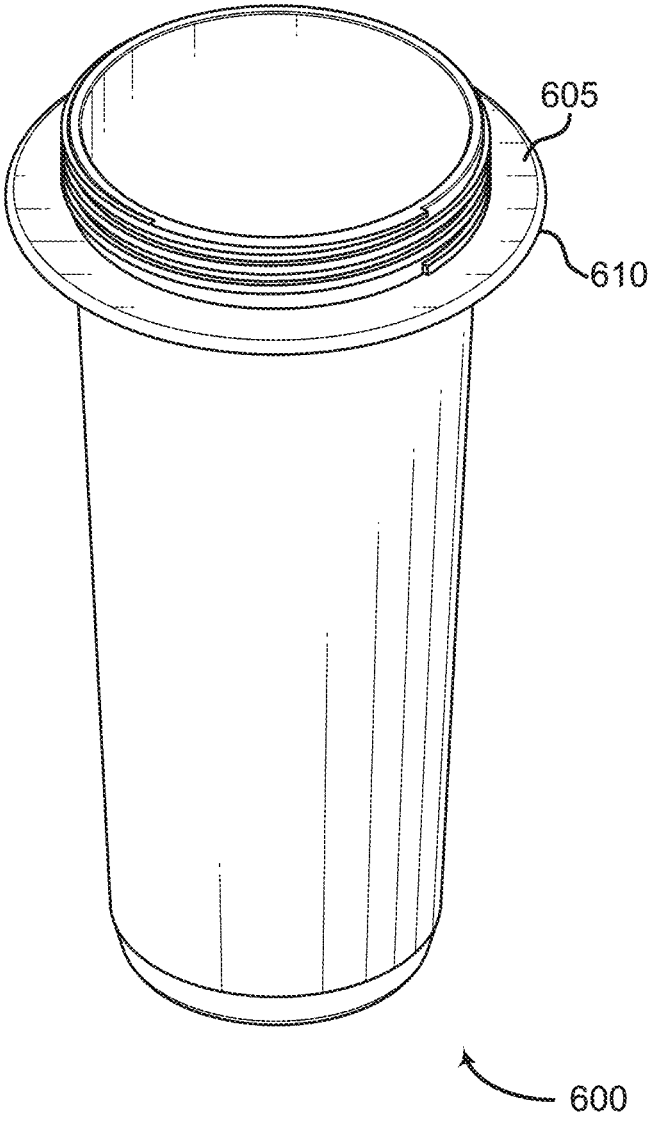
FIG. 6 shows an example of an inner cup of the cup system according to aspects of the present disclosure.

FIG. 6 shows an example of an inner cup 600 of the cup system according to aspects of the present disclosure. In one aspect, inner cup 600 includes engaging lip 605 and flange 610. Inner cup 600 is an example of, or includes aspects of, the corresponding element described with reference to FIGS. 2, 9, and 12.

Figure 9:
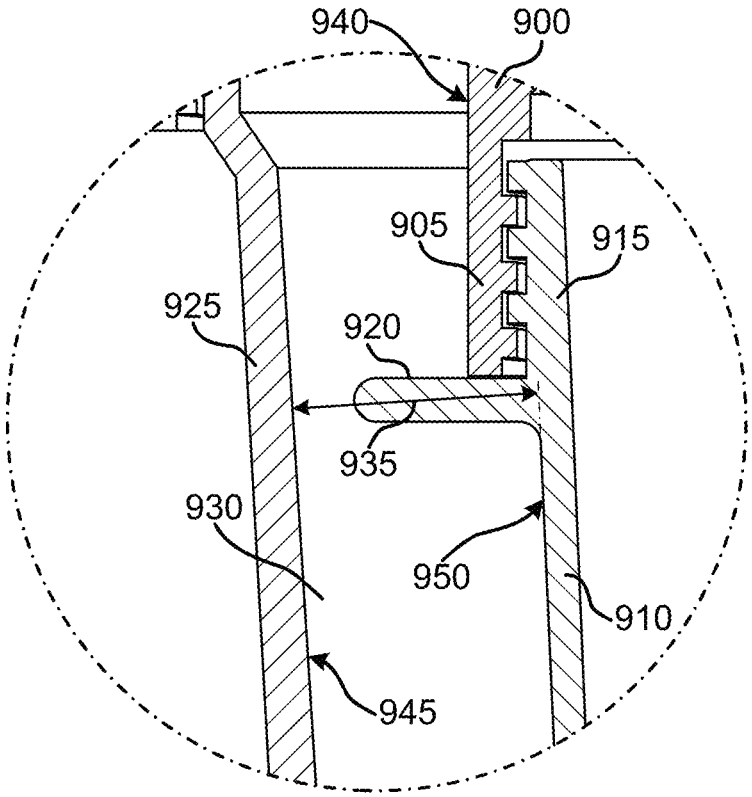
FIG. 9 shows an example of a junction of the cup system including the inner cup according to aspects of the present disclosure.

The engaging lip 605 is configured to engage with the lower inner lip of the lid (e.g., as shown in FIG. 9) to form a seal between the inner cup 600 and the lid. The engaging lip 605 also includes a flange 610 located below the engaging lip 605 and extending outward from a periphery of the inner cup 600.

The threaded plug (not shown) may be used to replace the inner cup 600 to convert the use to coffee/tea or other beverages. The threaded plug may be made of plastic and/or other composites with an insulated flange 610 to maintain the inner temperature of beverage.

Engaging lip 605 is an example of, or includes aspects of, the corresponding element described with reference to FIGS. 2, 7, and 9. Flange 610 is an example of, or includes aspects of, the corresponding element described with reference to FIGS. 2 and 9.

Figure 7:
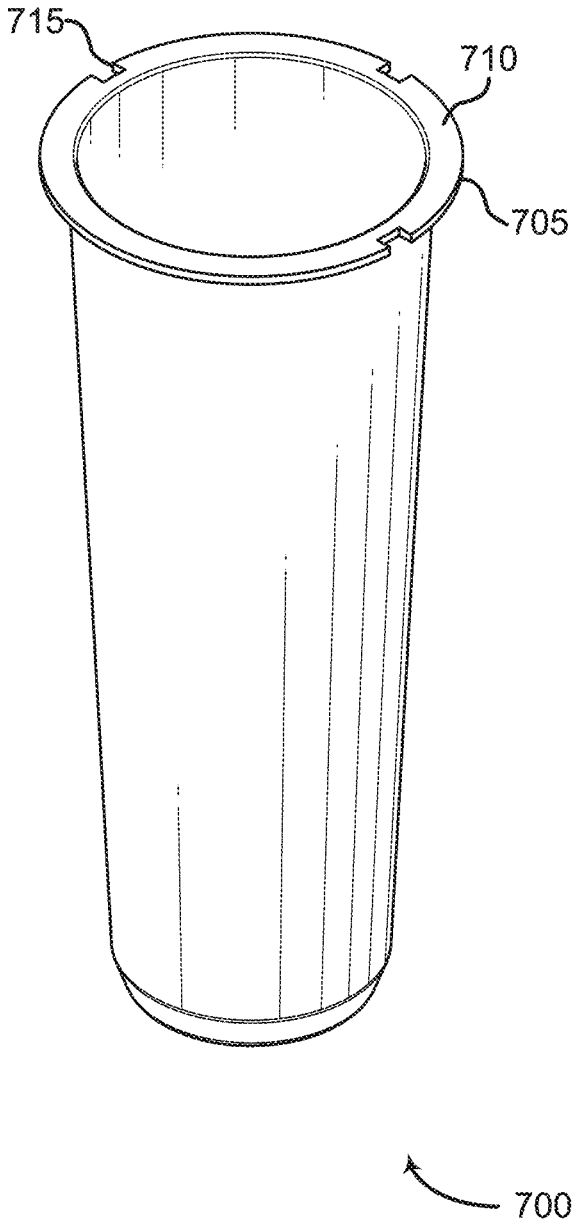
FIG. 7 shows an example of a pod of the cup system according to aspects of the present disclosure.

FIG. 7 shows an example of a pod 700 of the cup system according to aspects of the present disclosure. In one aspect, pod 700 includes outer flange 705, engaging lip 710, and mating engagement feature 715. Pod 700 is an example of, or includes aspects of, the corresponding element described with reference to FIG. 8. Engaging lip 710 is an example of, or includes aspects of, the corresponding element described with reference to FIGS. 2, 6, and 9.

Some examples of the apparatus, system, and method further include a pod 700 configured to be removably coupled to the cup system by sandwiching an outer flange 705 of the pod 700 between a ledge of the inner wall of the lid and a lower rim of the cap.

The pod 700 may be a conical cup made of plastic, paper, pulp, or other composites and may provide a long shelf life. The pod 700 may be a single-use for reusability and disposability. The exterior of the pod 700 may not commingle with liquid to mitigate contamination. Additionally, the pod 700 may be biodegradable to reduce resource waste.

According to some aspects, pod 700 is a cup comprising an engaging lip 710 including the outer flange 705 configured to seat on and be supported by the inner lip of the lid such that a body of the pod 700 cup extends downwards from the lid and an interior volume of the pod 700 cup is in communication with the central opening. The engaging lip 710 also includes a mating engagement feature 715 configured to align with the one or more engagement features of the lid. As such, the pod may be substantially aligned to the lid.

In some aspects, the outer flange 705 further includes a set of notches spaced around a perimeter of the flange, and where the inner wall further includes a set of bosses configured to be received by the set of notches, whereby rotation of the pod 700 cup with respect to the lid is prevented when the outer flange 705 is seated on the ledge.

Additionally, or alternatively, the pod 700 may include a cover (not shown) to fully or partially enclose the interior of the pod to hold a contents. The cover may be paper, foil, or the like and may be adhered to the engaging lip 710. As such, the user may remove the cover prior to inserting the pod to access the contents in the pod.

Figure 8:
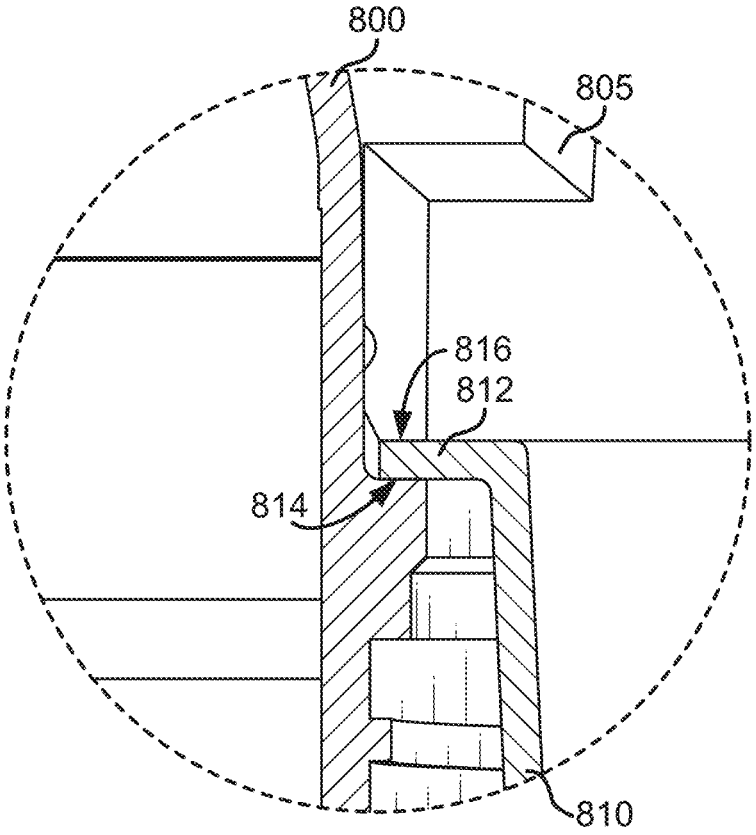
FIG. 8 shows an example of a junction of the cup system including the pod according to aspects of the present disclosure.

FIG. 8 shows an example of a junction of the cup system including the pod 810 according to aspects of the present disclosure. The example shown includes lid 800, cap 805, and pod 810. Lid 800 is an example of, or includes aspects of, the corresponding element described with reference to FIGS. 1-4, 9, and 12. Cap 805 is an example of, or includes aspects of, the corresponding element described with reference to FIGS. 1-3, 5, and 12. Pod 810 is an example of, or includes aspects of, the corresponding element described with reference to FIG. 7.

In some examples, lid 800 is configured to mate with the cap 805 and hold the pod 810 in place by sandwiching the outer flange 812 of the pod 810 between the lower rim 814 and the ledge 816.

FIG. 9 shows an example of a junction of the cup system including the inner cup 910 according to aspects of the present disclosure. The example shown includes lid 900, inner cup 910, outer cup 925 space 930, width of space at flange location 935, lid inner surface 940, outer cup inner surface 945, inner cup outer surface 950, and flange length 955.

The lid 900 is engaged with the inner cup 910 with a set of threads. The abutment of the lid 900 and inner cup 910 is due to the mating of the engaging lip 915 of the flange 920 against the lower inner lip 905 of the lid 900. In some examples, the engaging lip 915 is the surface of the flange 920 which mates with the lower inner lip 905. The lower inner lip 905 is a surface on the lid 900 which mates with the engaging lip 915.

In one aspect, lid 900 includes lower inner lip 905. Lid 900 is an example of, or includes aspects of, the corresponding element described with reference to FIGS. 1-4, 8, and 12.

In one aspect, inner cup 910 includes engaging lip 915 and flange 920. Flange 920 has a flange length 955, defining the outwards extent of the flange relative to the outer wall inner surface 950. Specifically, the flange length comprises at least half of a distance between the inner cup outer surface and the outer cup inner surface at the flange location. Inner cup 910 is an example of, or includes aspects of, the corresponding element described with reference to FIGS. 2, 6, and 12. Engaging lip 915 is an example of, or includes aspects of, the corresponding element described with reference to FIGS. 2, 6, and 7. Flange 920 is an example of, or includes aspects of, the corresponding element described with reference to FIGS. 2 and 6.

Outer cup 925 is an example of, or includes aspects of, the corresponding element described with reference to FIGS. 1, 2, and 12.

Figure 10:
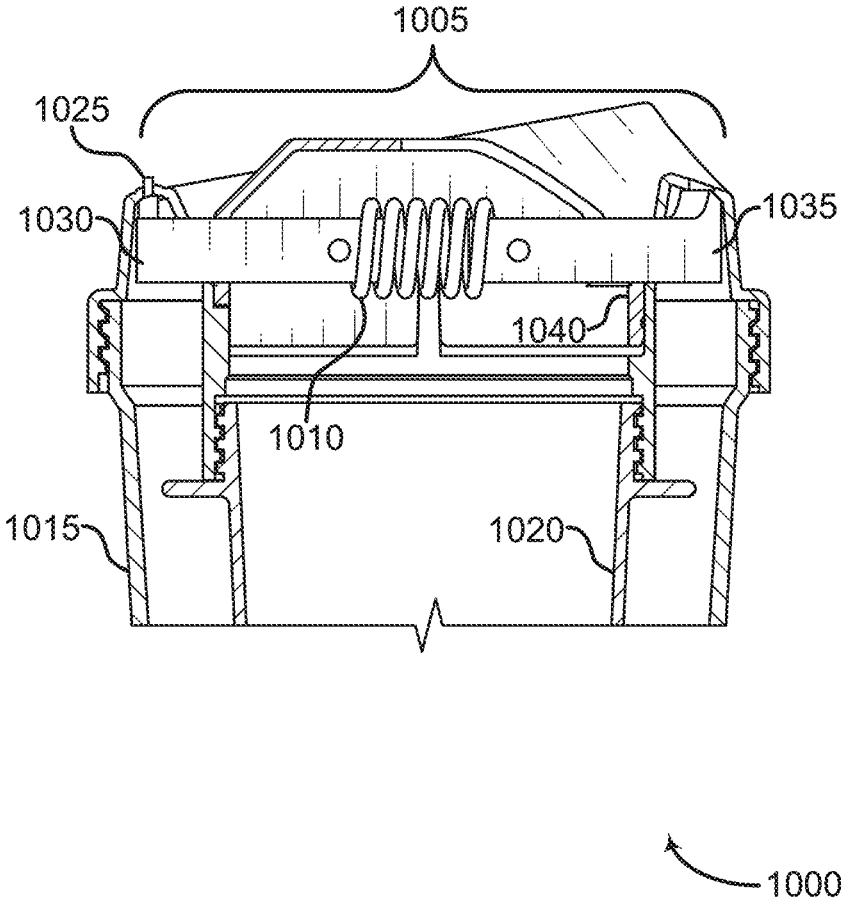
FIG. 10 shows an example of a cross section of the closed cup system according to aspects of the present disclosure.

FIG. 10 shows an example of a cross section of the closed cup system 1000 according to aspects of the present disclosure. In one aspect, cup system 1000 includes spring-activated hinge 1005, spring 1010, outer wall 1015, inner wall 1020, button 1025, fluid passage-sealing arm 1030, vent hole-sealing arm 1035, and engagement feature 1040. Cup system 1000 is an example of, or includes aspects of, the corresponding element described with reference to FIGS. 1-3, 11, and 12.

In some aspects, the fluid passage and the vent hole are controllably sealed by a mechanism coupled to the lid that is activated by a button 1025 coupled to the top rim of the lid.

Some examples of the apparatus, system, and method further include a mechanism comprising a spring-activated hinge 1005 coupled to a fluid passage-sealing arm 1030 and a vent hole-sealing arm 1035, wherein the hinge is biased such that the arms automatically seal the fluid passage and the vent hole and pressing the button 1025 biases the spring 1010 to unseal the fluid passage and the vent hole simultaneously.

The spring-activated hinge 1005 provides a spill-proof lid mechanism. The mechanism is triggered by a button 1025 located on the top surface of the lid. When the button 1025 is not depressed, the user may access the contents of the inner cup or pod. By depressing the button 1025, the spring 1010 unseals the fluid passage and the vent hole simultaneously. Therefore, the user may access the contents of the outer cup.

Button 1025 is used to activate the spring-activated hinge 1005 to controllably seal the fluid passage and vent holes.

The spring 1010 is shown as a coil spring 1010, but the present disclosure is not limited thereto and the spring 1010 may be a leaf spring 1010, torsion spring 1010, extension spring 1010, air spring 1010, or any type of conventional spring 1010.

Spring-activated hinge 1005 is an example of, or includes aspects of, the corresponding element described with reference to FIGS. 11 and 12. Spring 1010 is an example of, or includes aspects of, the corresponding element described with reference to FIG. 11. Outer wall 1015 is an example of, or includes aspects of, the corresponding element described with reference to FIG. 4. Inner wall 1020 is an example of, or includes aspects of, the corresponding element described with reference to FIG. 4. Button 1025 is an example of, or includes aspects of, the corresponding element described with reference to FIG. 11. Engagement feature 1040 is an example of, or includes aspects of, the corresponding element described with reference to FIGS. 2, 4, and 11.

Figure 11:
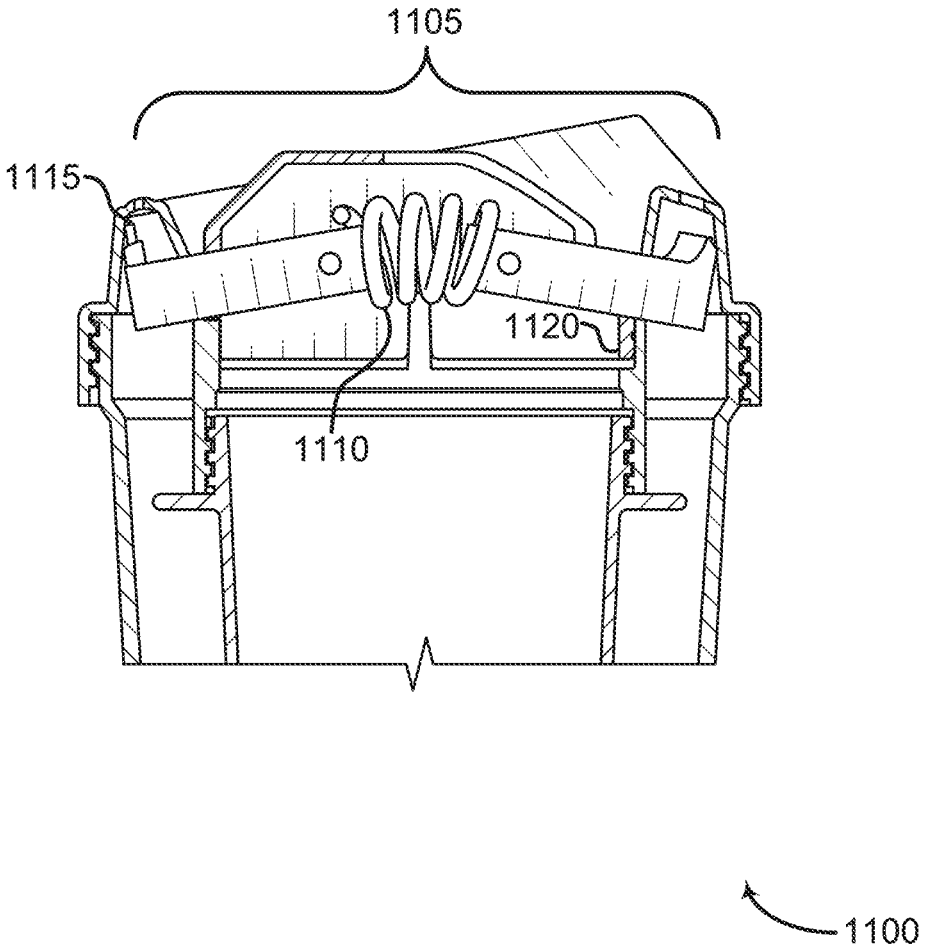
FIG. 11 shows an example of a cross section of the open cup system according to aspects of the present disclosure.

FIG. 11 shows an example of a cross section of the open cup system 1100 according to aspects of the present disclosure. In one aspect, cup system 1100 includes spring-activated hinge 1105, spring 1110, button 1115, and engagement feature 1120. Cup system 1100 is an example of, or includes aspects of, the corresponding element described with reference to FIGS. 1-3, 10, and 12.

The button 1115 is activated and the spring-activated hinge 1105 is deviated from the fluid passage and vent hole, allowing the contents of the outer cup to pass through the fluid passage.

Spring-activated hinge 1105 is an example of, or includes aspects of, the corresponding element described with reference to FIGS. 10 and 12. Spring 1110 is an example of, or includes aspects of, the corresponding element described with reference to FIG. 10. Button 1115 is an example of, or includes aspects of, the corresponding element described with reference to FIG. 10. Engagement feature 1120 is an example of, or includes aspects of, the corresponding element described with reference to FIGS. 2, 4, and 10.

Figure 12:
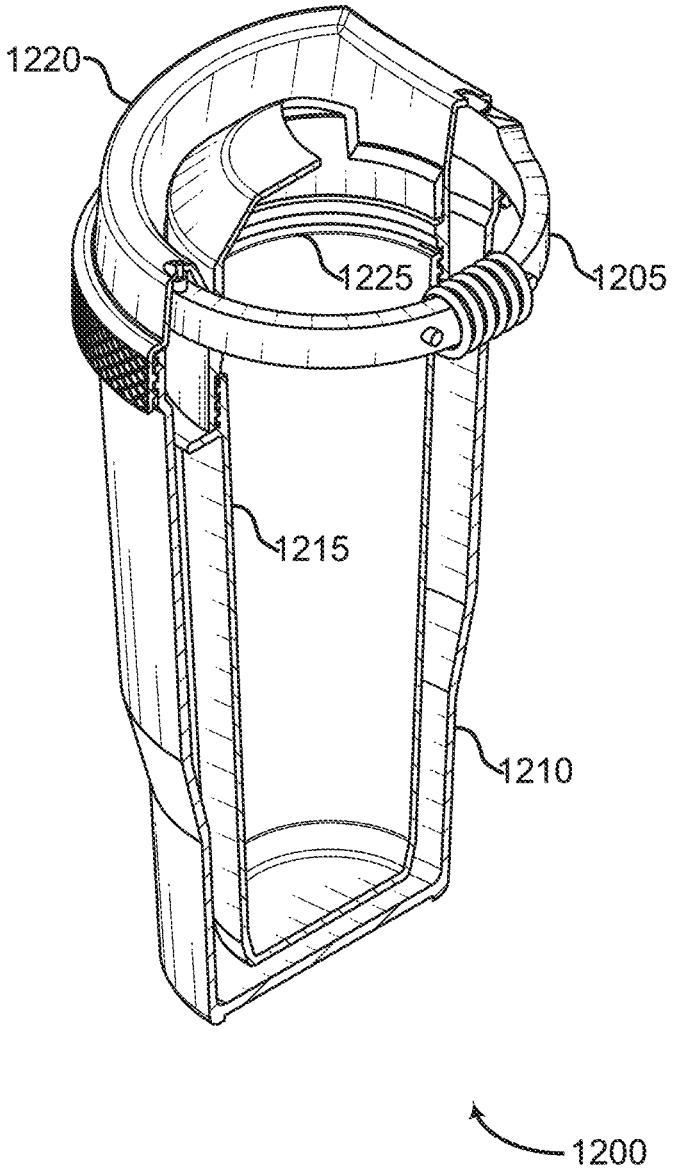
FIG. 12 shows an example of a perspective view cross section of the cup system according to aspects of the present disclosure.

FIG. 12 shows an example of a perspective view cross section of the cup system 1200 according to aspects of the present disclosure. In one aspect, cup system 1200 includes spring-activated hinge 1205, outer cup 1210, inner cup 1215, lid 1220, and cap 1225. Cup system 1200 is an example of, or includes aspects of, the corresponding element described with reference to FIGS. 1-3, 10, and 11.

In FIG. 12, the spring-activated hinge 1205 is shown in the closed position.

The outer cup 1210 is coupled to the lid 1220 using the threaded surface of the upper lip of the outer cup 1210. The inner cup 1215 is located within the outer cup 1210 with space between the inner and outer cups 1210. The lid 1220 is coupled to the outer cup 1210 and engages with the engaging lip of the inner cup 1215.

Spring-activated hinge 1205 is an example of, or includes aspects of, the corresponding element described with reference to FIGS. 10 and 11. Outer cup 1210 is an example of, or includes aspects of, the corresponding element described with reference to FIGS. 1, 2, and 9. Inner cup 1215 is an example of, or includes aspects of, the corresponding element described with reference to FIGS. 2, 6, and 9. Lid 1220 is an example of, or includes aspects of, the corresponding element described with reference to FIGS. 1-4, 8, and 9. Cap 1225 is an example of, or includes aspects of, the corresponding element described with reference to FIGS. 1-3, 5, and 8.

Figure 13:
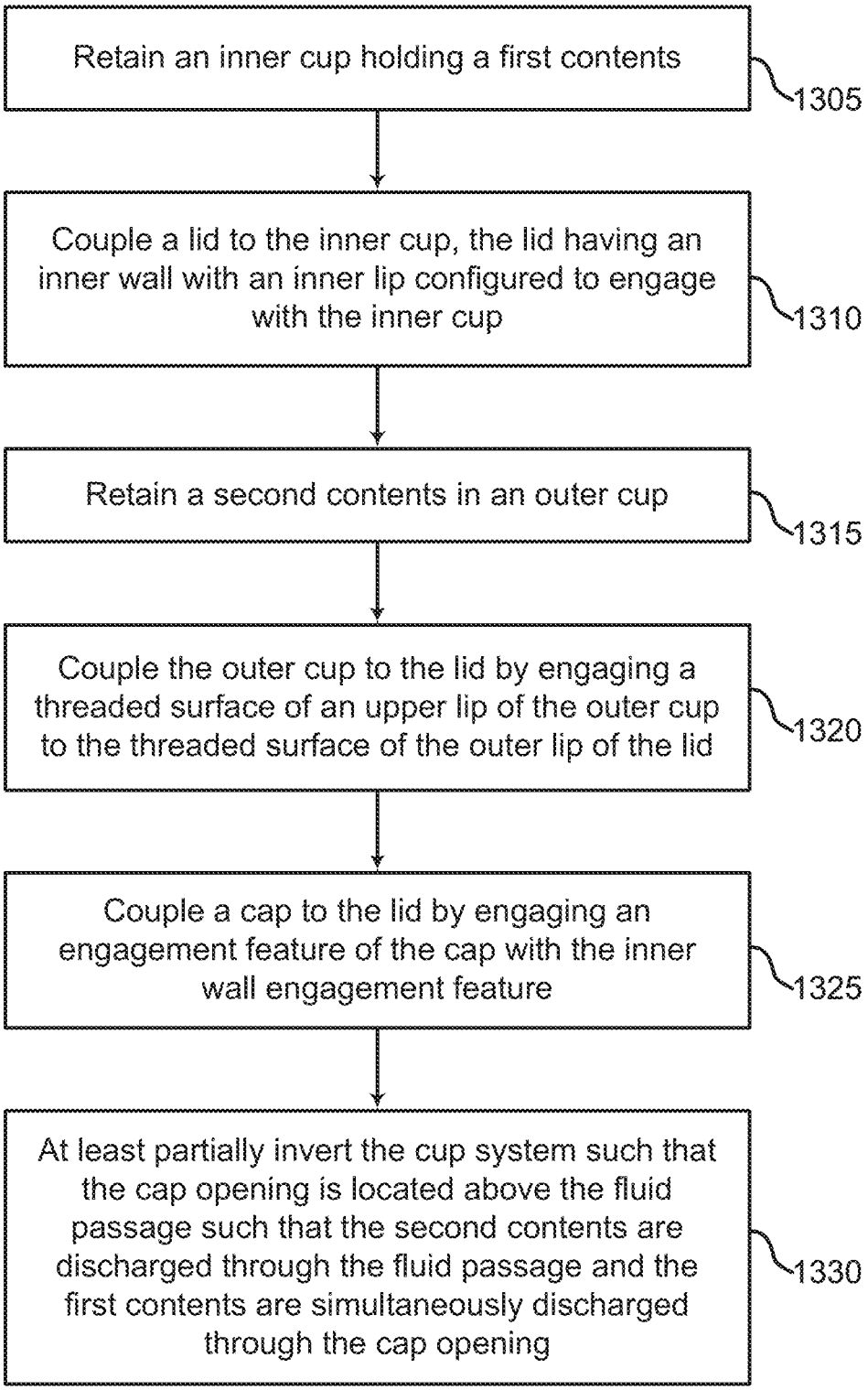
FIGS. 13 through 14 show examples of a method for using a drinking cup system according to aspects of the present disclosure.

FIG. 13 shows an example of a method 1300 for using a drinking cup system according to aspects of the present disclosure. In some examples, these operations are performed by a system including a processor executing a set of codes to control functional elements of an apparatus. Additionally, or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1305, the system retains an inner cup holding a first contents, where the inner cup includes an engaging lip, a flange located below the engaging lip and extending outward from a periphery of the inner cup. In some cases, the operations of this step refer to an inner cup as described with reference to FIGS. 2, 6, 9, and 12.

At operation 1310, the system couples a lid to the inner cup, the lid having an inner wall with an inner lip configured to engage with the inner cup, the coupling further including engaging the engaging lip of the inner cup with the inner lip of the lid. The inner wall further includes at least one engagement feature configured to engage with a mating engagement feature in a cap and the lid further includes an outer wall having an outer lip including a threaded surface, where a top edge of the inner wall is connected to a top edge of the outer wall. The inner wall further defines a central opening, and the lid further includes a vent hole and a fluid passage interposed between the lower outer lip and an inner edge of the lid, where the inner edge is at a periphery of the central opening. In some cases, the operations of this step refer to a lid as described with reference to FIGS. 1-4, 8, 9, and 12.

At operation 1315, the system retains a second contents in an outer cup. In some cases, the operations of this step refer to an outer cup as described with reference to FIGS. 1, 2, 9, and 12.

At operation 1320, the system couples the outer cup to the lid by engaging a threaded surface of an upper lip of the outer cup to the threaded surface of the outer lip of the lid, whereby the inner cup is nested within the outer cup with a space between the outer cup and the inner cup and the second contents in the space. In some cases, the operations of this step refer to an outer cup as described with reference to FIGS. 1, 2, 9, and 12.

At operation 1325, the system couples a cap to the lid by engaging an engagement feature of the cap with the inner wall engagement feature, whereby the cap is removably coupled to the lid and an opening in the cap provides a passage to an interior of the inner cup, whereby the cup system is formed. In some cases, the operations of this step refer to a cap as described with reference to FIGS. 1-3, 5, 8, and 12.

At operation 1330, the system inverts, at least partially, the cup system such that the cap opening is located above the fluid passage, whereby the second contents is discharged through the fluid passage and the first contents is simultaneously discharged through the cap opening. In some cases, the operations of this step refer to a cup system as described with reference to FIGS. 1-3, and 10-12.

Some examples of the method 1300 further include placing a contents in the inner cup prior to coupling the cap to the lid. In some aspects, the contents are dry contents. Some examples of the method and system further include placing a contents in the outer cup prior to coupling the outer cup to the lid.

In some aspects, the cap and the inner wall of the lid further include matching key structure, and wherein the step of coupling of the cap to the lid further includes matching the key structures.

Some examples of the method 1300 further include coupling a cap lid to the cap, whereby the opening is covered.

Figure 14:
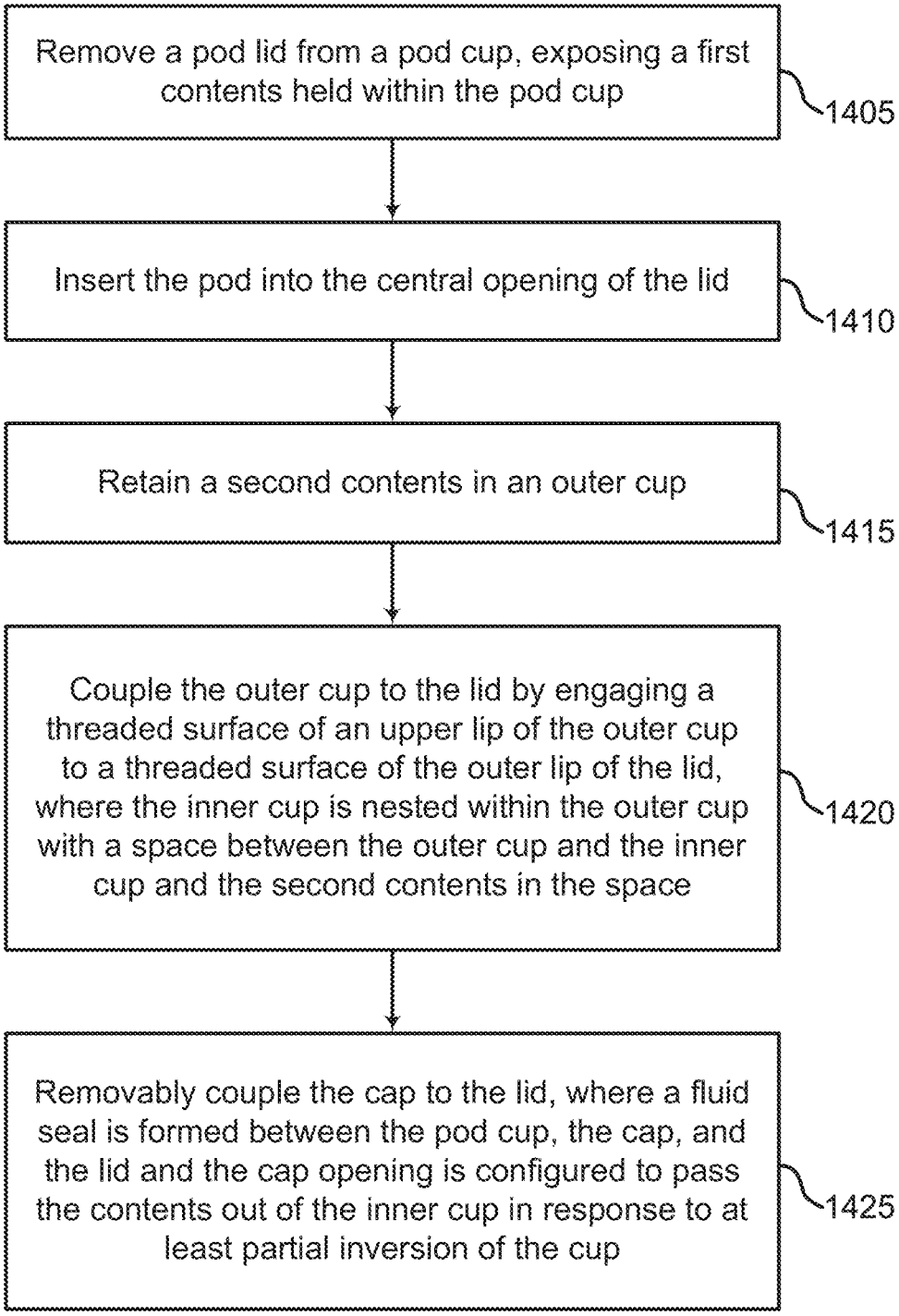

FIG. 14 shows an example of a method 1400 for using a drinking cup system according to aspects of the present disclosure. In some examples, these operations are performed by a system including a processor executing a set of codes to control functional elements of an apparatus.

Additionally, or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1405, the system removes a pod lid from a pod cup, exposing a first contents held within the pod cup, the pod cup including an engaging lip including an outer flange configured to seat on and be supported by a lid of the cup system such that a body of the pod cup extends downwards from the lid and an interior volume of the pod cup is in communication with a central opening of the lid. In some cases, the operations of this step refer to a pod as described with reference to FIGS. 7 and 8.

At operation 1410, the system inserts the pod into the central opening of the lid, the lid having an inner wall with an inner lip configured to engage with the inner cup, the coupling further including engaging the engaging lip of the inner cup with the inner lip of the lid. The inner wall further includes at least one engagement feature configured to engage with a mating engagement feature in a cap. The lid further includes an outer wall having an outer lip including a threaded surface, where a top edge of the inner wall is connected to a top edge of the outer wall. The inner wall further defines the central opening, and the lid further includes a vent hole and a fluid passage interposed between the lower outer lip and an inner edge of the lid, where the inner edge is at a periphery of the central opening. In some cases, the operations of this step refer to a pod as described with reference to FIGS. 7 and 8.

At operation 1415, the system retains a second contents in an outer cup. In some cases, the operations of this step refer to an outer cup as described with reference to FIGS. 1, 2, 9, and 12.

At operation 1420, the system couples the outer cup to the lid by engaging a threaded surface of an upper lip of the outer cup to the threaded surface of the outer lip of the lid, whereby the inner cup is nested within the outer cup with a space between the outer cup and the inner cup and the second contents in the space. In some cases, the operations of this step refer to an outer cup as described with reference to FIGS. 1, 2, 9, and 12.

At operation 1425, the system removably couples the cap to the lid by engaging the mating engagement feature with the inner wall engagement feature, whereby the outer flange is compressibly interposed between the inner lip of the lid and the lower rim of the cap. In some examples, a fluid seal is formed between the pod cup, the cap, and the lid, and the cap opening is configured to pass the contents out of the inner cup in response to at least partial inversion of the cup. In some cases, the operations of this step refer to a cap as described with reference to FIGS. 1-3, 5, 8, and 12.

In some aspects, the outer flange further includes a plurality of notches spaced around a perimeter of the flange, and wherein the inner wall further includes a plurality of bosses configured to be received by the plurality of notches, whereby rotation of the pod cup with respect to the lid is prevented when the outer flange is seated on the ledge.

Figure 15:
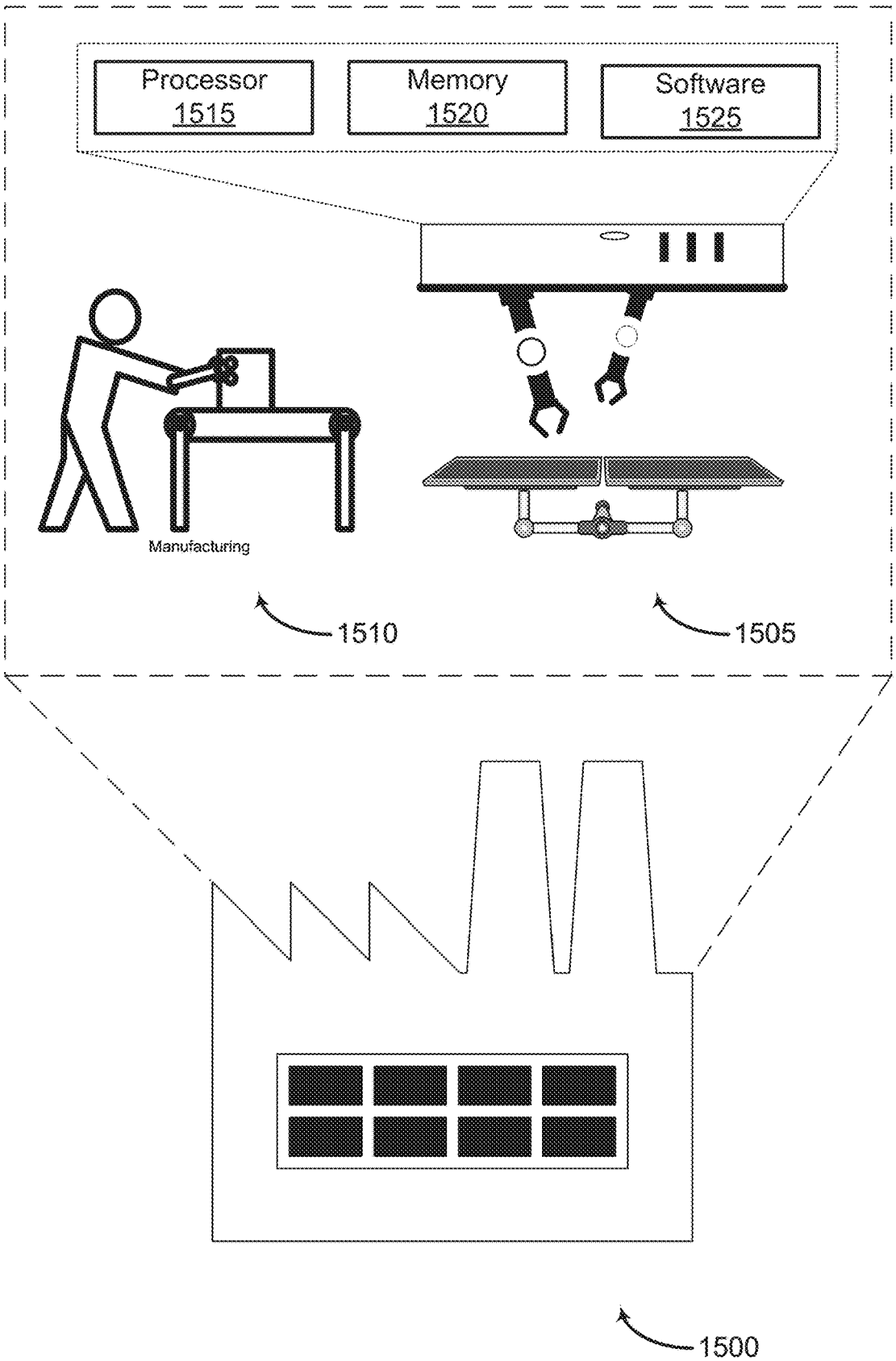
FIG. 15 shows an example of a system for manufacturing a drinking cup system according to aspects of the present disclosure.

FIG. 15 shows an example of a system for manufacturing a drinking cup system 1500 according to aspects of the present disclosure. In one aspect, system for manufacturing a drinking cup system 1500 includes manufacturing equipment 1505, personnel 1510, processor 1515, memory 1520, and software 1525.

Manufacturing equipment 1505 may operate autonomously, via remote control, by personnel 1510, etc. Manufacturing equipment 1505 may incorporate a variety of robotic and information systems to facilitate remote or independent operation. Manufacturing equipment 1505 may generally include various tools, robotic arms, molds, materials, chemicals, devices, etc. In some examples, manufacturing equipment 1505 may include a personal computer, laptop computer, mainframe computer, palmtop computer, personal assistant, mobile device, or any other suitable processing apparatus.

A processor 1515 is an intelligent hardware device, (e.g., a general-purpose processing component, a digital signal processor (DSP), a central processing unit (CPU), a graphics processing unit (GPU), a microcontroller, an application specific integrated circuit (ASIC), a field programmable gate array (FPGA), a programmable logic device, a discrete gate or transistor logic component, a discrete hardware component, or any combination thereof). In some cases, the processor 1515 is configured to operate a memory array using a memory controller. In other cases, a memory 1520 controller is integrated into the processor 1515. In some cases, the processor 1515 is configured to execute computer-readable instructions stored in a memory 1520 to perform various functions. In some embodiments, a processor 1515 includes special purpose components for modem processing, baseband processing, digital signal processing, or transmission processing.

Examples of a memory 1520 include random access memory (RAM), read-only memory (ROM), or a hard disk. Examples of memory 1520 include solid state memory and a hard disk drive. In some examples, memory 1520 is used to store computer-readable, computer-executable software 1525 including instructions that, when executed, cause a processor 1515 to perform various functions described herein. In some cases, the memory 1520 contains, among other things, a basic input/output system (BIOS) which controls basic hardware or software 1525 operation such as the interaction with peripheral components or devices. In some cases, a memory controller operates memory cells. For example, the memory controller can include a row decoder, column decoder, or both. In some cases, memory cells within a memory 1520 store information in the form of a logical state.

Software 1525 may include code to implement aspects of the present disclosure. Software 1525 may be stored in a non-transitory computer-readable medium such as system memory 1520 or other memory 1520. In some cases, the software 1525 may not be directly executable by the processor 1515 but may cause a computer (e.g., when compiled and executed) to perform functions described herein.

A database is an organized collection of data. For example, a database stores data in a specified format known as a schema. A database may be structured as a single database, a distributed database, multiple distributed databases, or an emergency backup database. In some cases, a database controller may manage data storage and processing in a database. In some cases, a user interacts with database controller. In other cases, database controller may operate automatically without user interaction.

Figure 16:
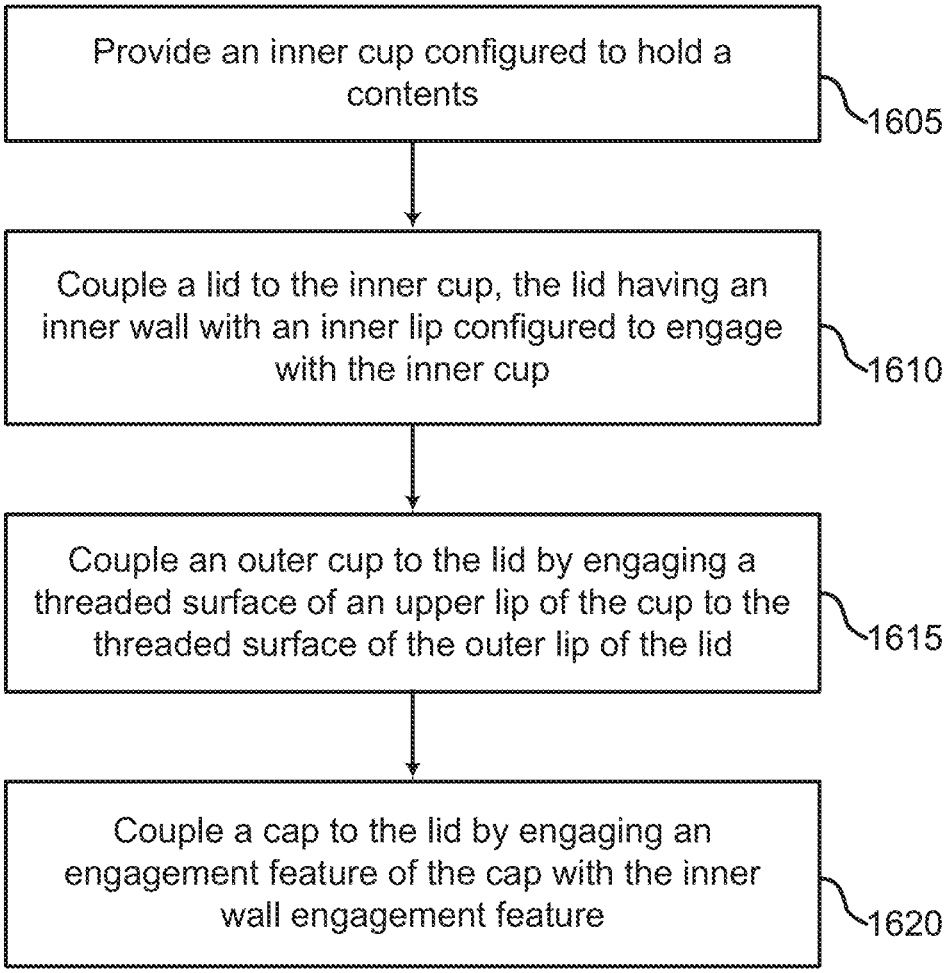
FIGS. 16 through 17 show examples of a method for manufacturing a drinking cup system according to aspects of the present disclosure.

FIG. 16 shows an example of a method 1600 for manufacturing a drinking cup system according to aspects of the present disclosure. In some examples, these operations are performed by a system including a processor executing a set of codes to control functional elements of an apparatus. Additionally, or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1605, the system provides an inner cup configured to hold a contents, where the inner cup includes an engaging lip and a flange located below the engaging lip and extending outward from a periphery of the inner cup. In some cases, the operations of this step refer to an inner cup as described with reference to FIGS. 2, 6, 9, and 12. In some cases, the operations of this step refer to, or may be performed by, a system for manufacturing a drinking cup system 1500 as described with reference to FIG. 15.

At operation 1610, the system couples a lid to the inner cup, the lid having an inner wall with an inner lip configured to engage with the inner cup. The coupling further includes engaging the engaging lip of the inner cup with the inner lip of the lid, the inner wall further includes at least one engagement feature configured to engage with a mating engagement feature in a cap, and the lid further includes an outer wall having an outer lip including a threaded surface. In some examples, a top edge of the inner wall is connected to a top edge of the outer wall, the inner wall further defines a central opening, and the lid further includes a vent hole and a fluid passage interposed between the lower outer lip and an inner edge of the lid. In some examples, the inner edge is at a periphery of the central opening. In some cases, the operations of this step refer to a lid as described with reference to FIGS. 1-4, 8, 9, and 12. In some cases, the operations of this step refer to, or may be performed by, a system for manufacturing a drinking cup system 1500 as described with reference to FIG. 15.

At operation 1615, the system couples an outer cup to the lid by engaging a threaded surface of an upper lip of the cup to the threaded surface of the outer lip of the lid, whereby the inner cup is nested within the outer cup with a space between the outer cup and the inner cup. In some cases, the operations of this step refer to an outer cup as described with reference to FIGS. 1, 2, 9, and 12. In some cases, the operations of this step refer to, or may be performed by, a system for manufacturing a drinking cup system 1500 as described with reference to FIG. 15.

At operation 1620, the system couples a cap to the lid by engaging an engagement feature of the cap with the inner wall engagement feature, whereby the cap is removably coupled to the lid and an opening in the cap provides a passage to an interior of the inner cup. In some examples, the cap opening is configured to pass the contents out of the inner cup in response to at least partial inversion of the cup. In some cases, the operations of this step refer to a cap as described with reference to FIGS. 1-3, 5, 8, and 12. In some cases, the operations of this step refer to, or may be performed by, a system for manufacturing a drinking cup system 1500 as described with reference to FIG. 15.

Figure 17:
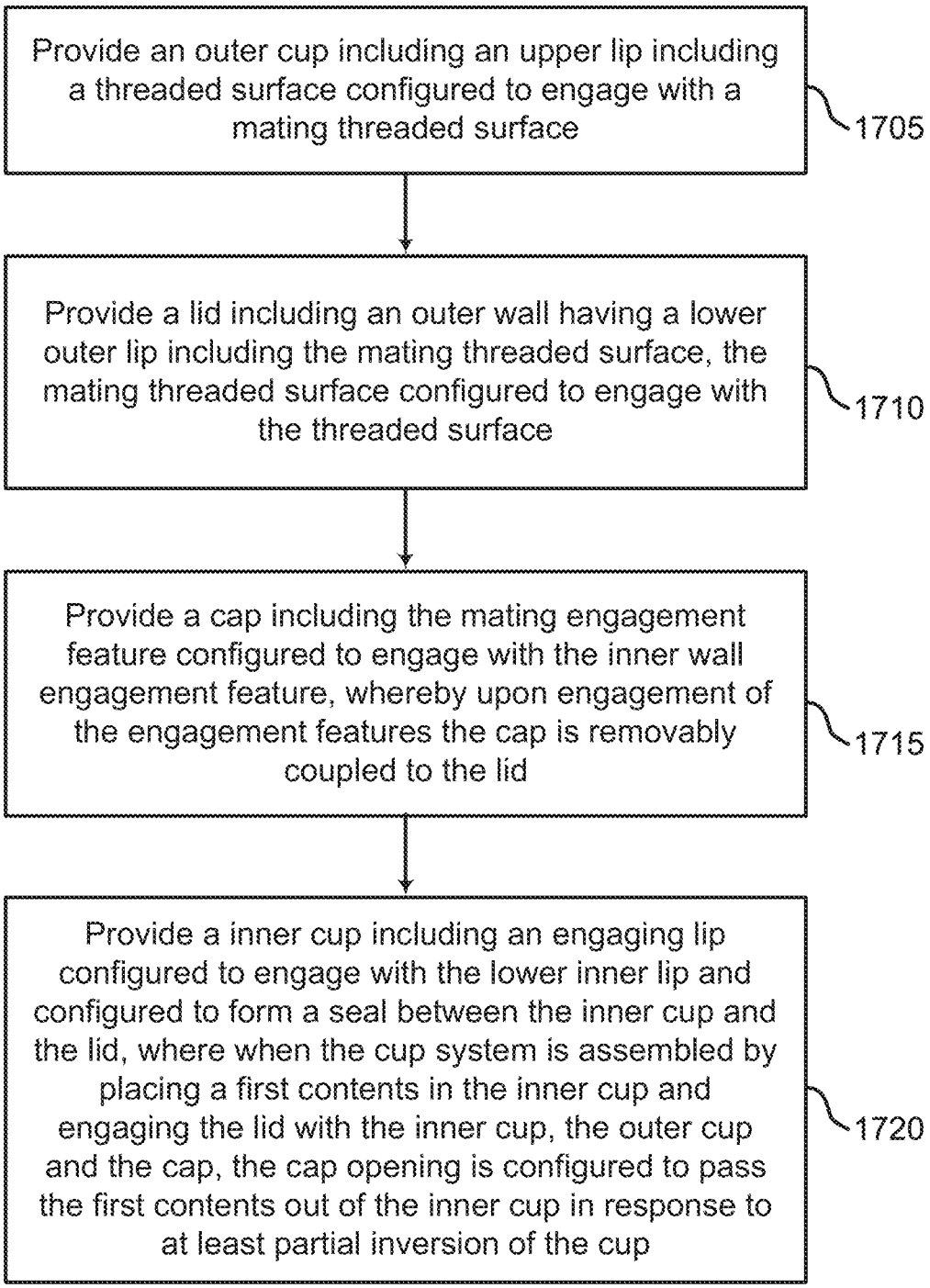

FIG. 17 shows an example of a method 1700 for manufacturing a drinking cup system according to aspects of the present disclosure. In some examples, these operations are performed by a system including a processor executing a set of codes to control functional elements of an apparatus. Additionally, or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1705, the system provides an outer cup including an upper lip including a threaded surface configured to engage with a mating threaded surface. In some cases, the operations of this step refer to an outer cup as described with reference to FIGS. 1, 2, 9, and 12. In some cases, the operations of this step refer to, or may be performed by, a system for manufacturing a drinking cup system 1500 as described with reference to FIG. 15.

At operation 1710, the system provides a lid including an outer wall, an inner wall, a fluid passage, and a vent. The outer wall has a lower outer lip including the mating threaded surface, the mating threaded surface configured to engage with the threaded surface. The inner wall defines a central opening, where a top edge of the inner wall is connected to a top edge of the outer wall, the inner wall including at least one engagement feature configured to engage with a mating engagement feature in a cap and having a lower inner lip configured to engage with an inner cup. The fluid passage in the lid is interposed between the lower outer lip and an inner edge of the lid, where the inner edge is at a periphery of the central opening. In some cases, the operations of this step refer to a lid as described with reference to FIGS. 1-4, 8, 9, and 12. In some cases, the operations of this step refer to, or may be performed by, a system for manufacturing a drinking cup system 1500 as described with reference to FIG. 15.

At operation 1715, the system provides a cap including the mating engagement feature and an opening. The mating engagement feature is configured to engage with the inner wall engagement feature, whereby upon engagement of the engagement features the cap is removably coupled to the lid and the central opening is spanned by the cap. In some cases, the operations of this step refer to a cap as described with reference to FIGS. 1-3, 5, 8, and 12. In some cases, the operations of this step refer to, or may be performed by, a system for manufacturing a drinking cup system 1500 as described with reference to FIG. 15.

At operation 1720, the system provides an inner cup including an engaging lip and a flange. The engaging lip is configured to engage with the lower inner lip and configured to form a seal between the inner cup and the lid. The flange is located below the engaging lip and extending outward from a periphery of the inner cup, where when the cup system is assembled by placing a first contents in the inner cup and engaging the lid with the inner cup, the outer cup and the cap, the cap opening is configured to pass the first contents out of the inner cup in response to at least partial inversion of the cup. In some cases, the operations of this step refer to an inner cup as described with reference to FIGS. 2, 6, 9, and 12. In some cases, the operations of this step refer to, or may be performed by, a system for manufacturing a drinking cup system 1500 as described with reference to FIG. 15.

In some aspects, the cap and the inner wall of the lid further include matching key structures such that coupling of the cap to the inner wall requires matching of the key structures.

Some examples of the drinking cup system further include an outer surface of the outer wall comprising a textured surface for gripping.

Some examples of the drinking cup system further include a threaded plug including a flange made of insulating materials, wherein the threaded plug is configured to couple to the lid in place of the inner cup.

Some examples of the drinking cup system further include an interference fit plug including a flange made of insulating materials, wherein the threaded plug is configured to couple to the lid in place of the inner cup.

In some aspects, the at least one engagement feature of the inner wall includes at least one horizontal indentation. In some aspects, the mating engagement feature of the cap includes at least one horizontal boss, wherein the at least one horizontal boss and the at least one horizontal indentation form a snap-lock coupling.

Lid may include a top rim is interposed between the top edge of the outer wall and the top edge of the inner wall. In some aspects, the fluid passage is located in the top rim.

In some aspects, the top rim is angled upward from the fluid passage such that the fluid passage is positioned at a trough of the top rim. In some aspects, the rim arcs slightly and continuously upward from the fluid passage.

In some aspects, vent hole is located in the top rim. In some aspects, the fluid passage is an open slot. In some aspects, the vent hole is located generally opposite to the fluid passage. In some examples, the vent hole is located next to the fluid passage.

In some aspects, an outer surface of a portion of the lid surrounding the vent hole is a raised convex oval shape. In some examples, the corresponding lower surface of the portion is a concave oval shape.

In some aspects, the at least one engagement feature of the lid inner wall includes a horizontal rib. In some aspects, the cap has a raised, convex shape.

In some aspects, the lid has a funnel design. In some aspects, the lid has a reverse funnel design.

Some examples of the drinking cup system further include a pod configured to be removably coupled to the cup system by sandwiching an outer flange of the pod between a ledge of the inner wall of the lid and a lower rim of the cap.

In some aspects, the fluid passage and the vent hole are controllably sealed by a mechanism coupled to the lid that is activated by a button coupled to the top rim of the lid.

Some examples of the drinking cup system further include a mechanism comprising a spring-activated hinge coupled to a fluid passage-sealing arm and a vent hole-sealing arm, wherein the hinge is biased such that the arms automatically seal the fluid passage and the vent hole and pressing the button biases the spring to unseal the fluid passage and the vent hole simultaneously.

Some examples of the drinking cup system further include a cap lid configured to cover the opening. Some examples of the drinking cup system further include a cap lid that attaches to the cap and flips into a position to cover the opening. Some examples of the drinking cup system further include a cap lid that is configured to snap to the cap to cover the opening.

Figure 18:
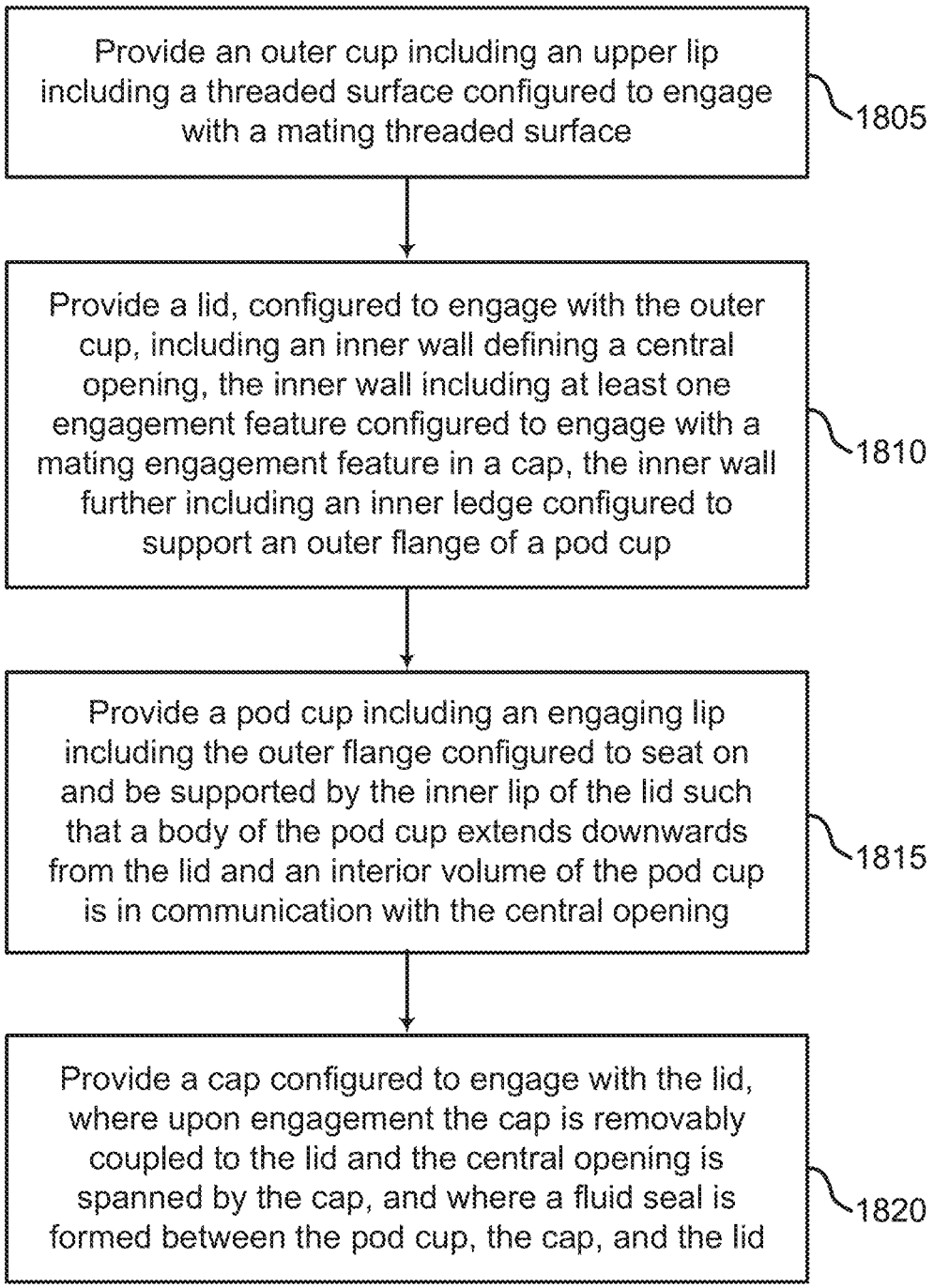
FIG. 18 shows an example of a method for manufacturing a drinking cup system according to aspects of the present disclosure.

FIG. 18 shows an example of a method 1800 for manufacturing a drinking cup system according to aspects of the present disclosure. In some examples, these operations are performed by a system including a processor executing a set of codes to control functional elements of an apparatus. Additionally, or alternatively, certain processes are performed using special-purpose hardware. Generally, these operations are performed according to the methods and processes described in accordance with aspects of the present disclosure. In some cases, the operations described herein are composed of various substeps, or are performed in conjunction with other operations.

At operation 1805, the system provides an outer cup including an upper lip including a threaded surface configured to engage with a mating threaded surface. In some cases, the operations of this step refer to an outer cup as described with reference to FIGS. 1, 2, 9, and 12. In some cases, the operations of this step refer to, or may be performed by, a system for manufacturing a drinking cup system 1500 as described with reference to FIG. 15.

At operation 1810, the system provides a lid including an outer wall, an inner wall, a fluid passage, and a vent. The outer wall has a lower outer lip including the mating threaded surface, the mating threaded surface configured to engage with the threaded surface. The inner wall defines a central opening, where a top edge of the inner wall is connected to a top edge of the outer wall, the inner wall including at least one engagement feature configured to engage with a mating engagement feature in a cap. The inner wall further includes an inner ledge configured to support an outer flange of a pod cup. The fluid passage in the lid is interposed between the lower outer lip and an inner edge of the lid, where the inner edge is at a periphery of the central opening. In some cases, the operations of this step refer to a lid as described with reference to FIGS. 1-4, 8, 9, and 12. In some cases, the operations of this step refer to, or may be performed by, a system for manufacturing a drinking cup system 1500 as described with reference to FIG. 15.

At operation 1815, the system provides a pod cup including an engaging lip including the outer flange configured to seat on and be supported by the inner lip of the lid such that a body of the pod cup extends downwards from the lid and an interior volume of the pod cup is in communication with the central opening. In some cases, the operations of this step refer to a pod as described with reference to FIGS. 7 and 8. In some cases, the operations of this step refer to, or may be performed by, a system for manufacturing a drinking cup system 1500 as described with reference to FIG. 15.

At operation 1820, the system provides a cap including the mating engagement feature, a lower rim, and an opening. The mating engagement feature is configured to engage with the inner wall engagement feature, whereby upon engagement of the engagement features the cap is removably coupled to the lid and the central opening is spanned by the cap. The lower rim is configured such that when the engagement features are engaged, the outer flange is compressibly interposed between the inner lip of the lid and the lower rim of the cap, whereby a fluid seal is formed between the pod cup, the cap, and the lid. When the cup system is assembled by placing a contents in the inner cup and engaging the lid with the pod cup, the outer cup and the cap, the cap opening is configured to pass the contents out of the inner cup in response to at least partial inversion of the cup. In some cases, the operations of this step refer to a cap as described with reference to FIGS. 1-3, 5, 8, and 12. In some cases, the operations of this step refer to, or may be performed by, a system for manufacturing a drinking cup system 1500 as described with reference to FIG. 15.

In some examples, the outer flange further comprises a plurality of notches spaced around a perimeter of the flange, and wherein the inner wall further comprises a plurality of bosses configured to be received by the plurality of notches, whereby rotation of the pod cup with respect to the lid is prevented when the outer flange is seated on the ledge.

While the invention herein disclosed has been described by means of specific embodiments, examples and applications thereof, numerous modifications and variations could be made thereto by those skilled in the art without departing from the scope of the invention set forth in the claims.

What is claimed is:

1. A cup system for simultaneous delivery of contents from separated cups to a mouth of a user, the cup system comprising:

an outer cup having an outer cup inner surface and including an upper lip comprising a threaded surface configured to engage with a mating threaded surface;

a lid having a lid inner surface and comprising:

an outer wall having a lower outer lip comprising the mating threaded surface, the mating threaded surface configured to engage with the threaded surface;

an inner wall defining a central opening, wherein a top edge of the inner wall is connected to a top edge of the outer wall, the inner wall comprising an engagement feature configured to engage with a mating engagement feature in a cap and having a lower inner lip configured to engage with an inner cup;

a fluid passage in the lid interposed between the lower outer lip and an inner edge of the lid, wherein the inner edge is at a periphery of the central opening; and a vent hole;

the cap comprising:

the mating engagement feature configured to engage with the inner wall engagement feature, whereby upon engagement of the engagement features the cap is removably coupled to the lid and the central opening is spanned by the cap; and an opening; and the inner cup having an inner cup outer surface and comprising:

an engaging lip configured to engage with the lower inner lip and configured to form a seal between the inner cup and the lid; and a flange located below the engaging lip and extending outward a flange length from a periphery of the inner cup outer surface, wherein when the cup system is assembled by placing a first contents in the inner cup, placing a second contents in the outer cup, and engaging the lid with the inner cup, the outer cup and the cap, a space is formed between the inner cup outer surface, the outer cup inner surface, and the lid inner surface, whereby the second contents is retained within the space and the flange extends past the inner wall of the lid, into the space, and towards the outer cup inner surface, wherein the flange length further comprises at least half of a distance between the inner cup outer surface and the outer cup inner surface at the flange location, and the cap opening is configured to pass the first contents out of the inner cup simultaneously with the second contents being passed through the space, past the flange, and discharged from the fluid passage in response to at least partial inversion of the cup.

2. The cup system for simultaneous delivery of contents from separated cups to the mouth of the user of claim 1, wherein a top rim is interposed between the top edge of the outer wall and the top edge of the inner wall.

3. The cup system for simultaneous delivery of contents from separated cups to the mouth of the user of claim 2, wherein the fluid passage is located in the top rim.

4. The cup system for simultaneous delivery of contents from separated cups to the mouth of the user of claim 3, wherein the top rim is angled upward from the fluid passage such that the fluid passage is positioned at a trough of the top rim, and the rim arcs continuously upward from the fluid passage.

5. The cup system for simultaneous delivery of contents from separated cups to the mouth of the user of claim 2, wherein the vent hole is located in the top rim.

6. The cup system for simultaneous delivery of contents from separated cups to the mouth of the user of claim 1, wherein the at least one engagement feature of the lid inner wall includes a horizontal rib.

7. The cup system for simultaneous delivery of contents from separated cups to the mouth of the user of claim 1, wherein the cap has a raised, convex shape.

8. The cup system for simultaneous delivery of contents from separated cups to the mouth of the user of claim 1, the cap and the inner wall of the lid further comprising matching key structures such that coupling of the cap to the inner wall requires matching of the key structures.

9. The cup system for simultaneous delivery of contents from separated cups to the mouth of the user of claim 1, further comprising a pod configured to be removably coupled to the cup system by sandwiching an outer flange of the pod between a ledge of the inner wall of the lid and a lower rim of the cap.

10. The cup system for simultaneous delivery of contents from separated cups to the mouth of the user of claim 3, wherein the fluid passage and the vent hole are controllably sealed by a mechanism coupled to the lid that is activated by a button coupled to the top rim of the lid.

11. The cup system for simultaneous delivery of contents from separated cups to the mouth of the user of claim 1, wherein an outer surface of a portion of the lid directly surrounding the vent hole is a raised convex oval shape.

12. A cup system for simultaneous delivery of contents from separated areas to a mouth of a user, the cup system comprising:

an outer cup having an outer cup inner surface and comprising an upper lip comprising a threaded surface configured to engage with a mating threaded surface;

a lid having a lid inner surface and comprising:

an outer wall having a lower outer lip comprising the mating threaded surface, the mating threaded surface configured to engage with the threaded surface;

an inner wall defining a central opening, wherein a top edge of the inner wall is connected to a top edge of the outer wall, the inner wall comprising at least one engagement feature configured to engage with a mating engagement feature in a cap, the inner wall and to engage with an inner cup and further comprising an inner ledge configured to support an outer flange of a pod cup;

a fluid passage in the lid interposed between the lower outer lip and an inner edge of the lid, wherein the inner edge is at a periphery of the central opening; and a vent hole;

the pod cup comprising:

an engaging lip including the outer flange configured to seat on and be supported by the inner ledge of the lid such that a body of the pod cup extends downwards from the lid and an interior volume of the pod cup is in communication with the central opening;

a cap comprising:

the mating engagement feature configured to engage with the inner wall engagement feature, whereby upon engagement of the engagement features the cap is removably coupled to the lid and the central opening is spanned by the cap;

a lower rim configured such that when the engagement features are engaged, the outer flange is compressibly interposed between the inner ledge of the lid and the lower rim of the cap, whereby a fluid seal is formed between the pod cup, the cap, and the lid; and an opening; and an inner cup having an inner cup outer surface and comprising:

an engaging lip configured to engage with the lower inner lip and configured to form a seal between the inner cup and the lid; and a flange located below the engaging lip and extending outward a flange length from a periphery of the inner cup outer surface, such that when the cup system is assembled by placing a first contents in the pod cup, placing a second contents in the outer cup, and engaging the lid with the pod cup, the outer cup, the inner cup, and the cap, a space is formed between the inner cup outer surface, the outer cup inner surface, and the lid, whereby the second contents is retained in the space and remains separated from the first contents, and the flange extends past the inner wall of the lid, into the space, and towards the outer cup inner surface, wherein the flange length further comprises at least half of a distance between the inner cup outer surface and the outer cup inner surface at the flange location, and the cap opening is configured to pass the first contents out of the pod cup simultaneously with the second contents being passed through the space, past the flange, and discharged from the fluid passage in response to at least partial inversion of the cup.

13. The cup system for simultaneous delivery of contents from separated areas to the mouth of the user of claim 12, wherein the outer flange further comprises a plurality of notches spaced around a perimeter of the flange, and wherein the inner wall further comprises a plurality of bosses configured to be received by the plurality of notches, whereby rotation of the pod cup with respect to the lid is prevented when the outer flange is seated on the inner ledge.

14. The cup system for simultaneous delivery of contents from separated areas to the mouth of the user of claim 12, wherein an outer surface of a portion of the lid directly surrounding the vent hole is a raised convex oval shape.

* * * * *